US011056773B2

(12) United States Patent
Kasani et al.

(10) Patent No.: US 11,056,773 B2
(45) Date of Patent: Jul. 6, 2021

(54) TWIN-BEAM BASE STATION ANTENNAS HAVING THINNED ARRAYS WITH TRIANGULAR SUB-ARRAYS

(71) Applicant: CommScope Technologies LLC, Hickory, NC (US)

(72) Inventors: Kumara Swamy Kasani, Godavarikhani (IN); Lenin Naragani, Hyderabad (IN)

(73) Assignee: CommScope Technologies LLC, Hickory, NC (US)

( * ) Notice: Subject to any disclaimer, the term of this patent is extended or adjusted under 35 U.S.C. 154(b) by 0 days.

(21) Appl. No.: 16/884,671

(22) Filed: May 27, 2020

(65) Prior Publication Data

US 2020/0411961 A1 Dec. 31, 2020

Related U.S. Application Data

(60) Provisional application No. 62/935,663, filed on Nov. 15, 2019.

(30) Foreign Application Priority Data

Jun. 28, 2019 (IN) ..... 201921025801

(51) Int. Cl.
*H01Q 19/10* (2006.01)
*H01Q 5/30* (2015.01)
(Continued)

(52) U.S. Cl.
CPC ..... *H01Q 1/246* (2013.01); *H01Q 3/34* (2013.01); *H01Q 19/106* (2013.01); *H01Q 21/061* (2013.01)

(58) Field of Classification Search
CPC .. H01Q 1/22; H01Q 1/24; H01Q 3/26; H01Q 3/34; H01Q 5/30; H01Q 21/06; H01Q 21/12; H01Q 21/24; H01Q 19/10
See application file for complete search history.

(56) References Cited

U.S. PATENT DOCUMENTS 6,937,191 B2 * 8/2005 Puente Baliarda .... H01Q 1/246 343/700 MS
2009/0312057 A1 12/2009 Moon et al.
(Continued)

FOREIGN PATENT DOCUMENTS

CN 103367932 A 10/2013
CN 206364193 U 7/2017
WO WO-0131747 A1 * 5/2001 ..... H01Q 1/246

OTHER PUBLICATIONS

"European Search Report corresponding to European Application No. 20180469.7, dated Nov. 18, 2020, 18 pages".
(Continued)

*Primary Examiner* — Blane J Jackson
(74) *Attorney, Agent, or Firm* — Myers Bigel, P.A.

(57) ABSTRACT

Twin-beam base station antennas include first and second arrays that each have a plurality of radiating elements that are mounted to extend forwardly from respective first and second panels of an angled reflector. The radiating elements in each array extend in three columns, with the radiating elements in the middle column vertically offset from the radiating elements in the outer columns. The antennas further include first and second phase shifters. More than half of the outputs of the first phase shifter are connected to respective first sub-arrays, where each first sub-array includes one radiating element from each of the three columns in the first array, and more than half of the outputs of the second phase shifter are connected to respective second sub-arrays, where each second sub-array includes one radiating element from each of the three columns in the second array.

21 Claims, 23 Drawing Sheets

(51) Int. Cl.

| | |
|---|---|
| ***H01Q 21/06*** | (2006.01) |
| ***H01Q 21/22*** | (2006.01) |
| ***H01Q 1/24*** | (2006.01) |
| ***H01Q 3/34*** | (2006.01) |

(56) References Cited

U.S. PATENT DOCUMENTS

| | | | | |
|---|---|---|---|---|
| 2013/0002505 | A1 | 1/2013 | Teillet et al. | |
| 2014/0242930 | A1* | 8/2014 | Barker | H01Q 21/08 455/129 |
| 2015/0222013 | A1* | 8/2015 | Choi | H01Q 21/293 343/879 |
| 2018/0294578 | A1* | 10/2018 | Xiao | H01Q 21/24 |
| 2019/0273309 | A1* | 9/2019 | Bisiules | H01Q 21/08 |

OTHER PUBLICATIONS

"Communication Pursuant to Article 94(3) EPC, corresponding to European Patent Application No. 20180469.7-1205, dated May 17, 2021, 17 pages".

"Derneryd Anders et al., "Higher Order Sectorization," in "Antennas for Base Stations," Jan. 1, 2009, McGraw Hill, NY, ISBN: 978-0-07-161289-0, pp. 154-165".

* cited by examiner

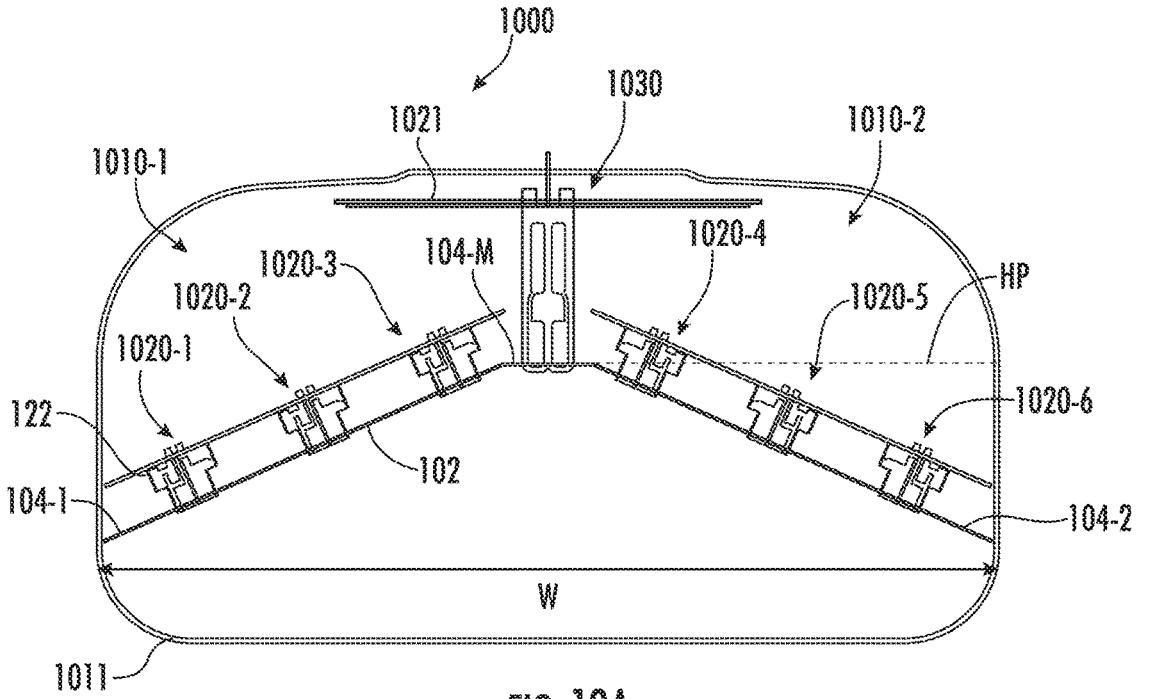
FIG. 10A
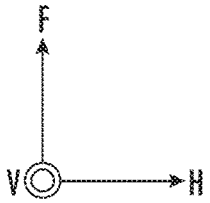
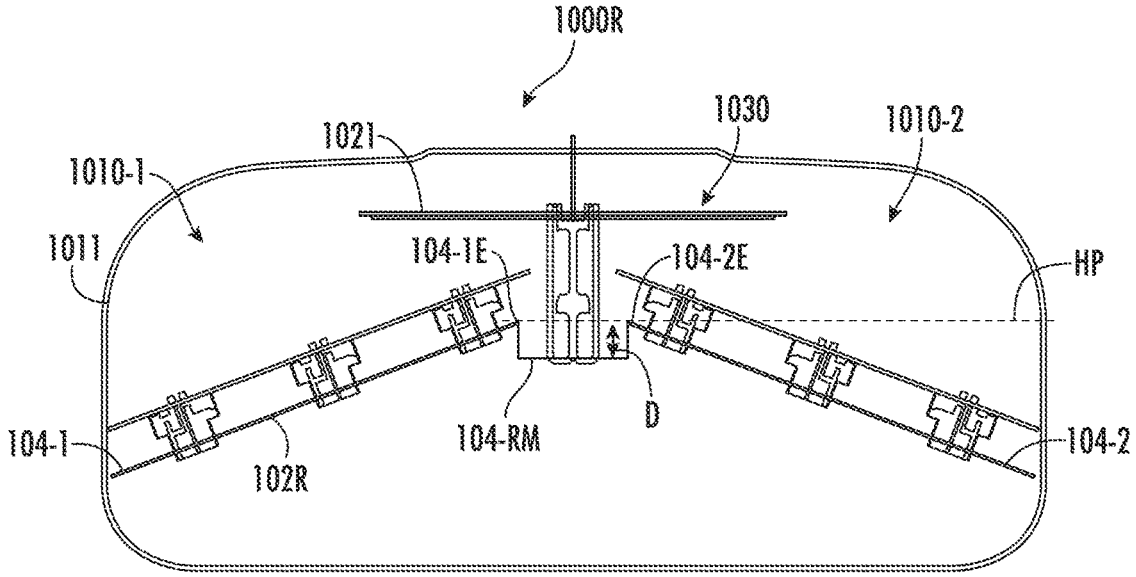
FIG. 10B
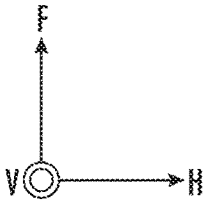

TWIN-BEAM BASE STATION ANTENNAS HAVING THINNED ARRAYS WITH TRIANGULAR SUB-ARRAYS

CROSS-REFERENCE TO RELATED APPLICATIONS

The present application claims priority to Indian Application Serial No. 201921025801, filed Jun. 28, 2019 and to U.S. Provisional Application Ser. No. 62/935,663, filed Nov. 15, 2019, the entire content of each of which is incorporated herein by reference.

FIELD OF THE INVENTION

The present invention generally relates to radio communications and, more particularly, to twin-beam base station antennas utilized in cellular and other communications systems.

BACKGROUND

Cellular communications systems are well known in the art. In a typical cellular communications system, a geographic area is divided into a series of regions that are referred to as "cells," and each cell is served by a base station. The base station may include baseband equipment, radios and base station antennas that are configured to provide two-way radio frequency ("RF") communications with subscribers that are positioned throughout the cell. In many cases, the cell may be divided into a plurality of "sectors," and separate base station antennas provide coverage to each of the sectors. The base station antennas are often mounted on a tower or other raised structure, with the radiation beam ("antenna beam") that is generated by each antenna directed outwardly to serve a respective sector. Typically, a base station antenna includes one or more phase-controlled arrays of radiating elements, with the radiating elements arranged in one or more vertical columns when the antenna is mounted for use. Herein, "vertical" refers to a direction that is perpendicular relative to the plane defined by the horizon.

A common base station configuration is a "three sector" configuration in which the cell is divided into three 120° sectors in the azimuth plane, and the base station includes three base station antennas that provide coverage to the three respective sectors. The azimuth plane refers to a horizontal plane that bisects the base station antenna that is parallel to the plane defined by the horizon. In a three sector configuration, the antenna beams generated by each base station antenna typically have a Half Power Beam Width ("HPBW") in the azimuth plane of about 65° so that the antenna beams provide good coverage throughout a 120° sector. Typically, each base station antenna will include a vertically-extending column of radiating elements that together generate an antenna beam. Each radiating element in the column may have a HPBW of approximately 65° so that the antenna beam generated by the column of radiating elements will provide coverage to a 120° sector in the azimuth plane. The base station antenna may include multiple columns of radiating elements that operate in the same or different frequency bands.

Most modern base station antennas also include remotely controlled phase shifter/power divider circuits along the RF transmission paths through the antenna that allow a phase taper to be applied to the sub-components of an RF signal that are supplied to the radiating element in an array. By adjusting the amount of phase taper applied, the resulting antenna beams may be electrically downtilted to a desired degree in the vertical or "elevation" plane. This technique may be used to adjust how far an antenna beam extends outwardly from an antenna, and hence can be used to adjust the coverage area of the base station antenna.

Sector-splitting refers to a technique where the coverage area for a base station is divided into more than three sectors in the azimuth plane, such as six, nine or even twelve sectors. A six-sector base station will have six 60° sectors in the azimuth plane. Splitting each 120° sector into two sub-sectors increases system capacity because each antenna beam provides coverage to a smaller area, and therefore can provide higher antenna gain and/or allow for frequency reuse within a 120° sector. In six-sector sector-splitting applications, a single twin-beam antenna is typically used for each 120° sector. The twin-beam antenna generates two separate antenna beams that each have a reduced size in the azimuth plane and that each point in different directions in the azimuth plane, thereby splitting the sector into two smaller sub-sectors. The antenna beams generated by a twin-beam antenna used in a six-sector configuration preferably have azimuth HPBW values of, for example, between about 27°-39°, and the pointing directions for the first and sector sector-splitting antenna beams in the azimuth plane are typically at about −27° and about 27°, respectively.

Several approaches have been used to implement twin-beam antennas that provide coverage to respective first and second sub-sectors of a 120° sector in the azimuth plane. In a first approach, first and second columns of radiating elements are mounted on the two major interior faces of a V-shaped reflector. The angle defined by the interior surface of the "V" shaped reflector may be about 54° so that the two columns of radiating elements are mechanically positioned or "steered" to point at azimuth angles of about −27° and 27°, respectively (i.e., toward the middle of the respective sub-sectors). Since the azimuth HPBW of typical radiating elements is usually appropriate for covering a full 120° sector, an RF lens is mounted in front of the two columns of radiating elements that narrows the azimuth HPBW of each antenna beam by a suitable amount for providing coverage to a 60° sub-sector. Unfortunately, however, the use of RF lenses may increase the size, weight and cost of the base station antenna, and the amount that the RF lens narrows the beamwidth is a function of frequency, making it difficult to obtain suitable coverage when wideband radiating elements are used that operate over a wide frequency range (e.g., radiating elements that operate over the full 1.7-2.7 GHz cellular frequency range).

In a second approach, two or more columns of radiating elements (typically 2-4 columns) are mounted on a flat reflector so that each column points toward the boresight pointing direction for the antenna (i.e., the azimuth boresight pointing direction of a base station antenna refers to a horizontal axis extending from the base station antenna to the center, in the azimuth plane, of the sector served by the base station antenna). Two RF ports (per polarization) are coupled to all of the columns of radiating elements through a beamforming network such as a Butler Matrix. The beamforming network generates two separate antenna beams (per polarization) based on the RF signals input at the two RF ports, and the antenna beams are electrically steered off the boresight pointing direction of the antenna at azimuth angles of about −27° and 27° to provide coverage to the two sub-sectors. With such beamforming network based twin-beam antennas, the pointing angle in the azimuth plane of each antenna beam and the HPBW of each antenna beam may vary as a function of the frequency of the RF signals input at the two RF ports. In particular, the azimuth pointing direction of the antenna beams (i.e., the azimuth angle where peak gain occurs) tends to move toward the boresight pointing direction of the antenna and the azimuth HPBW tends to get smaller with increasing frequency. This can lead to a large variation as a function of frequency in the power level of the antenna beam at the outside edges of the sub-sectors, which is undesirable.

In a third approach, a multi-column array of radiating elements (typically three columns per array) is mounted on each exterior panel of a V-shaped reflector to provide a sector-splitting twin-beam antenna. The antenna beams generated by each multi-column array may vary less as a function of frequency as compared to the lensed and beam-forming based twin beam antennas discussed above. Unfortunately, such sector-splitting antennas may require a large number of radiating elements, which increases the cost and weight of the antenna. Additionally, the inclusion of six columns of radiating elements may increase the required width for the antenna and the V-shaped reflector may increase the depth of the antenna, both of which may be undesirable.

Generally speaking, cellular operators desire twin-beam antennas that have azimuth HPBW values of anywhere between 30°-38°, so long as the azimuth HPBW does not vary significantly (e.g., more than 12°) across the operating frequency band. Likewise, the azimuth pointing angle of the antenna beam peak may vary anywhere between +/−26° to +/−33°, so long as the azimuth pointing angle does not vary significantly (e.g., more than 4°) across the operating frequency band. The peak azimuth sidelobe levels should be at least 15 dB below the peak gain value.

SUMMARY

Pursuant to embodiments of the present invention, twin-beam base station antennas are provided that include an angled reflector having a first planar panel and a second planar panel that is angled with respect to the first planar panel, as well as first and second arrays. The first array includes a first plurality of radiating elements that extend forwardly from the first planar panel, where the radiating elements extend in three vertically-extending columns, and the radiating elements in the middle of the three vertically-extending columns are vertically offset from the radiating elements in the other two of the three vertically-extending columns. The second array includes a second plurality of radiating elements that extend forwardly from the second planar panel, where the radiating elements extend in three vertically-extending columns, and the radiating elements in the middle of the three vertically-extending columns are vertically offset from the radiating elements in the other two of the three vertically-extending columns. The antenna further includes first and second phase shifters that have inputs and respective pluralities of first and second phase shifter outputs. More than half of the first phase shifter outputs are connected to respective ones of a plurality of first sub-arrays, where each first sub-array includes a total of one radiating element from each of the three columns in the first array, and more than half of the second phase shifter outputs are connected to respective ones of a plurality of second sub-arrays, where each second sub-array includes a total of one radiating element from each of the three columns in the second array.

In some embodiments, the three radiating elements included in each first sub-array may be arranged to define a triangle, and the three radiating elements included in each second sub-array may likewise be arranged to define a triangle.

In some embodiments, the three radiating elements included in each first sub-array may be mounted on a common feed board printed circuit board that includes a pair of 1×3 power dividers, and the three radiating elements included in each second sub-array may be mounted on a common feed board printed circuit board that includes a pair of the 1×3 power dividers.

In some embodiments, the three radiating elements included in each first sub-array may include radiating elements in the outer columns that are horizontally aligned with each other, and a radiating element in the middle column that is vertically offset from the radiating elements in the outer columns.

In some embodiments, the outer columns in the first array and the outer columns in the second array may be separated in the horizontal direction by between 0.5λ and 0.95λ, where λ is the wavelength corresponding to the center frequency of the operating frequency bands of the first and second arrays.

In some embodiments, the radiating elements in the middle column of the first array may be offset in the vertical direction by between 0.6λ and 0.9λ from the closest radiating elements in the outer columns in the first array, and the radiating elements in the middle column of the second array may be offset in the vertical direction by between 0.6λ and 0.9λ from the closest radiating elements in the outer columns in the second array where λ is the wavelength corresponding to the center frequency of the operating frequency bands of the first and second arrays.

In some embodiments, each radiating element may be configured to operate in at least a portion of the 1.695 MHz to 2.690 MHz frequency band.

In some embodiments, the 1×3 power dividers may be unequal power dividers and may provide a larger amount of power to radiating elements in the middle column than to the radiating elements in the out columns.

In some embodiments, one of the first phase shifter outputs may be connected to a third sub-array that includes a total of one radiating element from each of the outer columns in the first array, and one of the second phase shifter outputs may be connected to a fourth sub-array that includes a total of one radiating element from each of the outer columns in the second array.

In some embodiments, the first array may include an equal number of first sub-arrays both above and below the third sub-array, and the second array may similarly include an equal number of second sub-arrays both above and below the fourth sub-array.

In some embodiments, the first array and the second array may each include a total of either twenty or twenty one radiating elements.

In some embodiments, each first sub-array may include a V-shaped feedboard or a triangular shaped feedboard.

Pursuant to further embodiments of the present invention, twin-beam base station antennas are provided that include an angled reflector having a first planar panel and a second planar panel that is angled with respect to the first planar panel, as well as first and second arrays. The first array includes a first plurality of radiating elements that extend forwardly from the first planar panel, where the radiating elements extend in three vertically-extending columns, and the radiating elements in the middle of the three vertically-extending columns are vertically offset from the radiating elements in the other two of the three vertically-extending columns. The second array includes a second plurality of radiating elements that extend forwardly from the second planar panel, where the radiating elements extend in three vertically-extending columns, and the radiating elements in the middle of the three vertically-extending columns are vertically offset from the radiating elements in the other two of the three vertically-extending columns. The first and third columns in the first array and the first and third columns in the second array are separated by between 0.5λ and 0.95λ, where λ is the wavelength corresponding to the center frequency of the operating frequency bands of the first and second arrays. The radiating elements in the second column of the first array are offset in the vertical direction by between 0.6λ and 0.9λ from the closest radiating elements in the first and third columns in the first array, and the radiating elements in the second column of the second array are offset in the vertical direction by between 0.6λ and 0.9λ from the closest radiating elements in the first and third columns in the second array.

In some embodiments, all or all but one of the first phase shifter outputs may be connected to respective ones of a plurality of first sub-arrays, where each first sub-array includes a total of one radiating element from each of the three columns in the first array, and all or all but one of the second phase shifter outputs may be connected to respective ones of a plurality of second sub-arrays, where each second sub-array includes a total of one radiating element from each of the three columns in the second array.

In some embodiments, the three radiating elements included in each first and second sub-array may arranged to define a triangle.

In some embodiments, the three radiating elements included in each first sub-array and in each second sub-array may be mounted on a common feed board printed circuit board that includes a pair of 1×3 power dividers. In some embodiments, the 1×3 power dividers may be unequal power dividers and provide a larger amount of power to radiating elements in the middle column than to the radiating elements in the outer columns.

In some embodiments, one of the first phase shifter outputs may be connected to a third sub-array that includes a total of one radiating element from each of the outer columns in the first array, and one of the second phase shifter outputs may be connected to a fourth sub-array that includes a total of one radiating element from each of the outer columns in the second array.

In some embodiments, the first array may include an equal number of first sub-arrays both above and below the third sub-array, and the second array may include an equal number of second sub-arrays both above and below the fourth sub-array.

In some embodiments, the first array and the second array may each include a total of either twenty or twenty one radiating elements.

A base station antenna, according to some embodiments of the present invention, may include a reflector having first and second tilted portions and a recessed flat middle portion that is between, and recessed relative to respective adjacent ends of, the first and second tilted portions. The base station antenna may include a vertical column of low-band radiating elements on the recessed flat middle portion of the reflector. The base station antenna may include a first plurality of vertical columns of high-band radiating elements on the first tilted portion of the reflector. Moreover, the base station antenna may include a second plurality of vertical columns of high-band radiating elements on the second tilted portion of the reflector.

In some embodiments, the recessed flat middle portion of the reflector may be recessed relative to the respective adjacent ends of the first and second tilted portions of the reflector by 20-40 millimeters. Moreover, the base station antenna may include a radome, and the first and second tilted portions of the reflector may slope toward each other in a forward direction toward a front side of the radome.

According to some embodiments, the first plurality of vertical columns of high-band radiating elements may include consecutive first, second, and third vertical columns of high-band radiating elements, and the second plurality of vertical columns of high-band radiating elements may include consecutive fourth, fifth, and sixth vertical columns of high-band radiating elements. The second vertical column of high-band radiating elements may be vertically staggered relative to the first and third vertical columns of high-band radiating elements, and the fifth vertical column of high-band radiating elements may be vertically staggered relative to the fourth and sixth vertical columns of high-band radiating elements. In some embodiments, the second vertical column of high-band radiating elements may be aligned in a horizontal direction with the fourth and sixth vertical columns of high-band radiating elements, and the fifth vertical column of high-band radiating elements may be aligned in the horizontal direction with the first and third vertical columns of high-band radiating elements. Moreover, respective center points of the low-band radiating elements may not be aligned in the horizontal direction with respective center points of any of the high-band radiating elements.

In some embodiments, an innermost one of the first plurality of vertical columns of high-band radiating elements may be vertically staggered relative to an innermost one of the second plurality of vertical columns of high-band radiating elements.

A base station antenna, according to some embodiments of the present invention, may include a reflector having first and second tilted portions and a flat middle portion that is between the first and second tilted portions. The base station antenna may include a vertical column of low-band radiating elements on the flat middle portion of the reflector. The base station antenna may include a first vertically-staggered plurality of vertical columns of high-band radiating elements on the first tilted portion of the reflector. The base station antenna may include a second vertically-staggered plurality of vertical columns of high-band radiating elements on the second tilted portion of the reflector. An innermost one of the first vertically-staggered plurality of vertical columns may be vertically staggered relative to an innermost one of the second vertically-staggered plurality of vertical columns.

In some embodiments, the base station antenna may include a third vertically-staggered plurality of vertical columns of high-band radiating elements on the flat middle portion of the reflector. The first vertically-staggered plurality of vertical columns may include consecutive first and second vertical columns of high-band radiating elements. The third vertically-staggered plurality of vertical columns may include consecutive third and fourth vertical columns of high-band radiating elements. The second vertically-staggered plurality of vertical columns may include consecutive fifth and sixth vertical columns of high-band radiating elements. Moreover, the first vertical column of high-band radiating elements may be aligned in a horizontal direction with the third and fifth vertical columns of high-band radiating elements, and the second vertical column of high-band radiating elements may be aligned in the horizontal direction with the fourth and sixth vertical columns of high-band radiating elements.

According to some embodiments, the flat middle portion of the reflector may be recessed relative to respective ends of the first and second tilted portions of the reflector that are adjacent the flat middle portion.

In some embodiments, the vertical column of low-band radiating elements may be a first vertical column of low-band radiating elements, and the base station may include a second vertical column of low-band radiating elements on the flat middle portion of the reflector and vertically staggered relative to the first vertical column of low-band radiating elements.

A base station antenna, according to some embodiments of the present invention, may include first and second reflector surfaces that are tilted relative to each other. The base station antenna may include a first vertical column of low-band radiating elements on the first reflector surface. The base station antenna may include a second vertical column of low-band radiating elements on the second reflector surface. The base station antenna may include a first vertically-staggered plurality of vertical columns of high-band radiating elements on the first reflector surface. Moreover, the base station antenna may include a second vertically-staggered plurality of vertical columns of high-band radiating elements on the second reflector surface.

In some embodiments, the base station antenna may include a recessed flat middle reflector surface that is between, and recessed relative to respective adjacent ends of, the first and second reflector surfaces. The first vertically-staggered plurality of vertical columns may include consecutive first, second, and third vertical columns of high-band radiating elements. The second vertically-staggered plurality of vertical columns may include consecutive fourth, fifth, and sixth vertical columns of high-band radiating elements. Moreover, the base station antenna may include a seventh vertical column of high-band radiating elements on the recessed flat middle reflector surface.

According to some embodiments, the first vertical column of low-band radiating elements may be aligned in a vertical direction with the second vertical column of high-band radiating elements, and the second vertical column of low-band radiating elements may be aligned in the vertical direction with the fifth vertical column of high-band radiating elements.

In some embodiments, the base station antenna may include third and fourth vertical columns of low-band radiating elements on the first and second reflector surfaces, respectively. The third vertical column of low-band radiating elements may be vertically staggered relative to the first vertical column of low-band radiating elements, and the fourth vertical column of low-band radiating elements may be vertically staggered relative to the second vertical column of low-band radiating elements. Moreover, the first vertical column of low-band radiating elements may be aligned in a vertical direction with the second vertical column of high-band radiating elements, the third vertical column of low-band radiating elements may be aligned in the vertical direction with the third vertical column of high-band radiating elements, the second vertical column of low-band radiating elements may be aligned in the vertical direction with the fourth vertical column of high-band radiating elements, and the fourth vertical column of low-band radiating elements may be aligned in the vertical direction with the fifth vertical column of high-band radiating elements.

According to some embodiments, the second vertical column of high-band radiating elements may include consecutive first through fourth high-band radiating elements. The first and second high-band radiating elements may be spaced apart from each other in a vertical direction by a first distance. Moreover, the second and third high-band radiating elements may be spaced apart from each other in the vertical direction by a second distance that is twice the first distance, and the third and fourth high-band radiating elements may be spaced apart from each other in the vertical direction by a third distance that is triple the first distance.

BRIEF DESCRIPTION OF THE DRAWINGS

FIG. 10A is a transverse cross-sectional view of a twin-beam base station antenna according to embodiments of the present invention.

FIG. 10B is a transverse cross-sectional view of a twin-beam base station antenna according to embodiments of the present invention.

DETAILED DESCRIPTION

Pursuant to embodiments of the present invention, improved twin-beam base station antennas are provided that overcome or mitigate various of the difficulties with conventional twin-beam antennas. The twin-beam antennas according to embodiments of the present invention may include thinned three column arrays of radiating elements where most or all of the radiating elements are fed as triangular sub-arrays. The twin-beam base station antennas according to embodiments of the present invention may include only about two-thirds as many radiating elements as comparable conventional twin-beam antennas while achieving comparable performance.

Before discussing the twin-beam base station antennas according to embodiments of the present invention, it is helpful to examine a variety of potential twin-beam antenna designs.

Most conventional single-beam base station antennas include one or more vertically-oriented columns of dual-polarized radiating elements. Each dual-polarized radiating element in one of these arrays includes a first polarization radiator and a second polarization radiator. The most commonly used dual-polarized radiating element are cross-dipole radiating elements that include a slant −45° dipole radiator and a slant +45° degree dipole radiator. The slant −45° dipole radiator of each cross-dipole radiating element in a column is coupled to a first (−45°) RF port, and the +45° dipole radiator of each cross-dipole radiating element in the column is coupled to a second (+45°) RF port. Such a column of cross-dipole radiating elements will generate a first −45° polarization antenna beam in response to RF signals input at the first RF port, and will generate a second +45° polarization antenna beam in response to RF signals input at the second RF port. In the description below, each base station antenna is described as having slant −45°/+45° cross-dipole radiating elements for convenience and ease of comparison. It will be appreciated, however, that any appropriate radiating elements may be used including, for example, single polarization dipole radiating elements or patch radiating elements, in other embodiments As noted above, most cross-dipole radiating elements are designed to have a half-power azimuth beamwidth ("HPBW") of about 65°. Consequently, a column of conventional cross-dipole radiating elements will generate antenna beams having an azimuth HPBW of about 65°, which is about twice as wide as is appropriate for a twin beam antenna. This can be seen with reference to FIGS. 1A-1C.

Figure 1A:
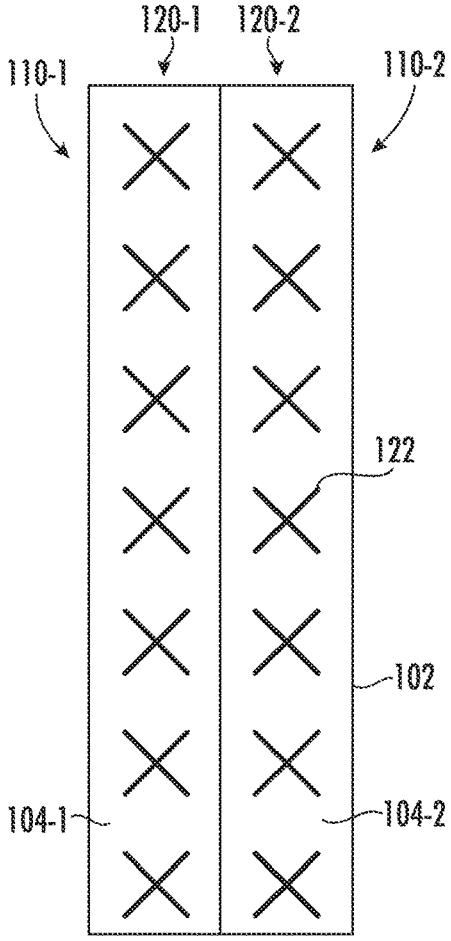
FIG. 1A is a schematic plan view of a twin-beam base station antenna having a single column of individually-fed radiating elements mounted on each of the two major faces of a V-shaped reflector.
Figure 1B:
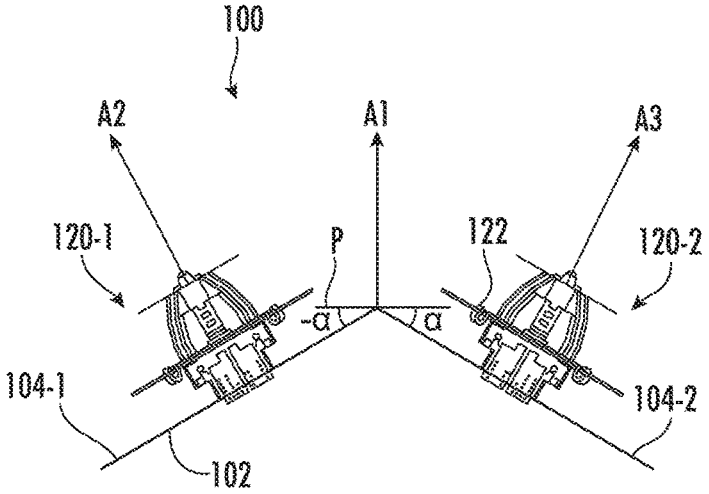
FIG. 1B is a schematic transverse cross-sectional view of the base station antenna of FIG. 1A.
Figure 1C:
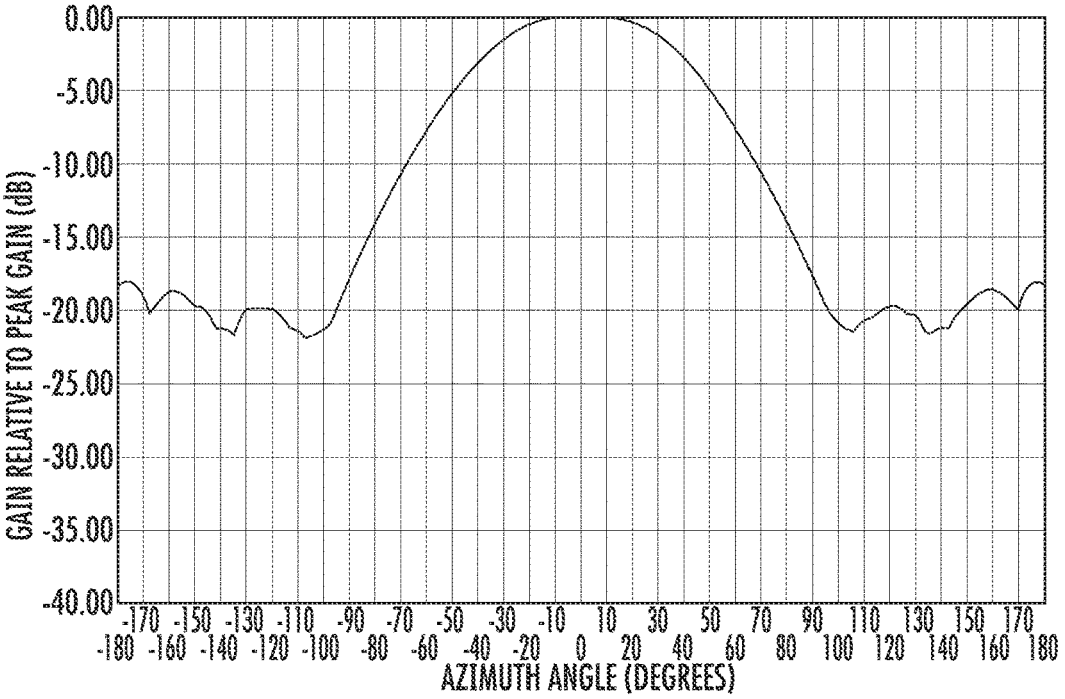
FIG. 1C is a graph of the "envelope" of the azimuth pattern for the base station antenna of FIG. 1A.

In particular, FIG. 1A is a schematic plan view of a base station antenna 100 that includes a single column of individually-fed radiating elements mounted on each of the two major faces of a V-shaped reflector 102. FIG. 1B is a schematic transverse cross-sectional view of the base station antenna 100 of FIG. 1A. FIG. 1C is a graph of the "envelope" of the azimuth pattern for the base station antenna 100. As known to those of skill in the art, the azimuth and elevation patterns for the antenna beams generated by a base station antenna are typically evaluated at a number of different frequencies across the operating frequency band of the radiating elements used to generate the antenna beam. Herein, the "envelope" of the azimuth or elevation patterns refers to a curve that represents the highest value at each frequency in the azimuth and elevation patterns. In evaluating the performance of a base station antenna, it may be simpler to look to the envelopes of the azimuth and elevation patterns than to the many different curves that represent the azimuth and elevation patterns at a large number of different frequencies.

As shown in FIG. 1A, the base station antenna 100 includes a longitudinally-extending reflector 102 that has first and second columns 120-1, 120-2 of radiating elements 122 mounted thereon. Herein, when multiple of the same elements are included in an antenna, the elements may be referred to individually by their full reference numeral (e.g., column 120-2) and collectively by the first part of their reference numerals (e.g., the columns 120). The reflector 102 may comprise a metallic sheet that serves as a ground plane for the radiating elements 122 and that also redirects forwardly much of the backwardly-directed radiation emitted by the radiating elements 122.

The reflector 102 is V-shaped (see FIG. 1B) and hence includes first and second panels 104-1, 104-2 that are angled with respect to each other. An imaginary axis A1 that extends through the vertex of the "V" may point at the approximate middle, in the azimuth plane, of the sector that is served by the base station antenna 100. The first panel 104-1 may be angled by an angle $-\alpha$ from a plane P that is perpendicular to the axis A1, and the second panel 104-2 may be angled by an angle $\alpha$ from the plane P. The radiating elements 122 in the first column 120-1 are mounted to extend forwardly from the first panel 104-1 and together form a first array 110-1. The radiating elements 122 in the second column 120-2 are mounted to extend forwardly from the second panel 104-2 and together form a second array 110-2. The peak radiation of the antenna beams generated by the first array 110-1 will extend outwardly along an axis A2 that is perpendicular to the first panel 104-1, and the peak radiation of the antenna beams generated by the second array 110-2 will extend outwardly along an axis A3 that is perpendicular to the second panel 104-2. The angle $\alpha$ is typically selected to be about 27°-30° so that the antenna beams generated by the first and second arrays 110 will point at the approximate middle of the respective two sub-sectors of a sector covered by the base station antenna 100.

The base station antenna 100 is compact and relatively inexpensive since it does not include a large number of radiating elements 122. Unfortunately, however, it is not suitable for use as a twin-beam antenna because the radiating elements 122 each generate antenna beams having an azimuth HPBW of about 65°. As shown in FIG. 1C, a vertically-oriented column of these radiating elements 122, such as columns 120-1 and 120-2, will generate antenna beams having an azimuth HPBW of about 65°. Such antenna beams are unsuitable for covering a 60° sub-sector as a nearly half the signal energy will fall outside the sub-sector, where it is not beneficial and where it appears as interference in neighboring sub-sectors.

Figure 2A:
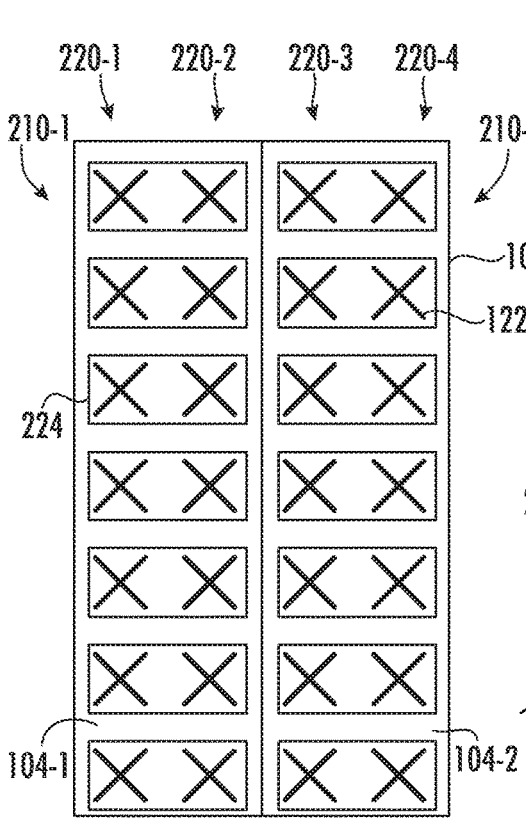
FIG. 2A is a schematic plan view of a twin-beam base station antenna having two columns of radiating elements that are fed as 2×1 sub-arrays mounted on each of the two major faces of a V-shaped reflector.
Figure 2B:
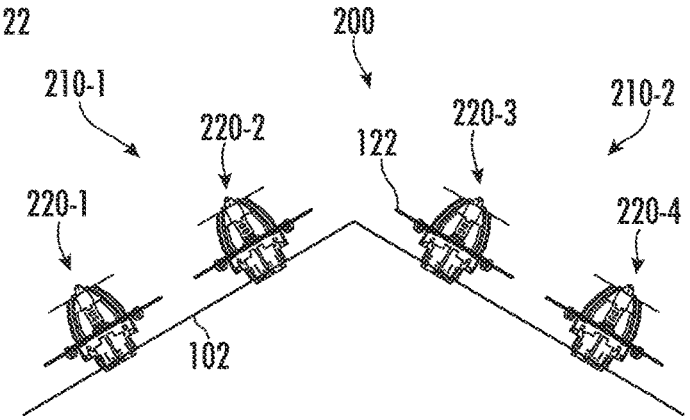
FIG. 2B is a schematic transverse cross-sectional view of the base station antenna of FIG. 2A.
Figure 2C:
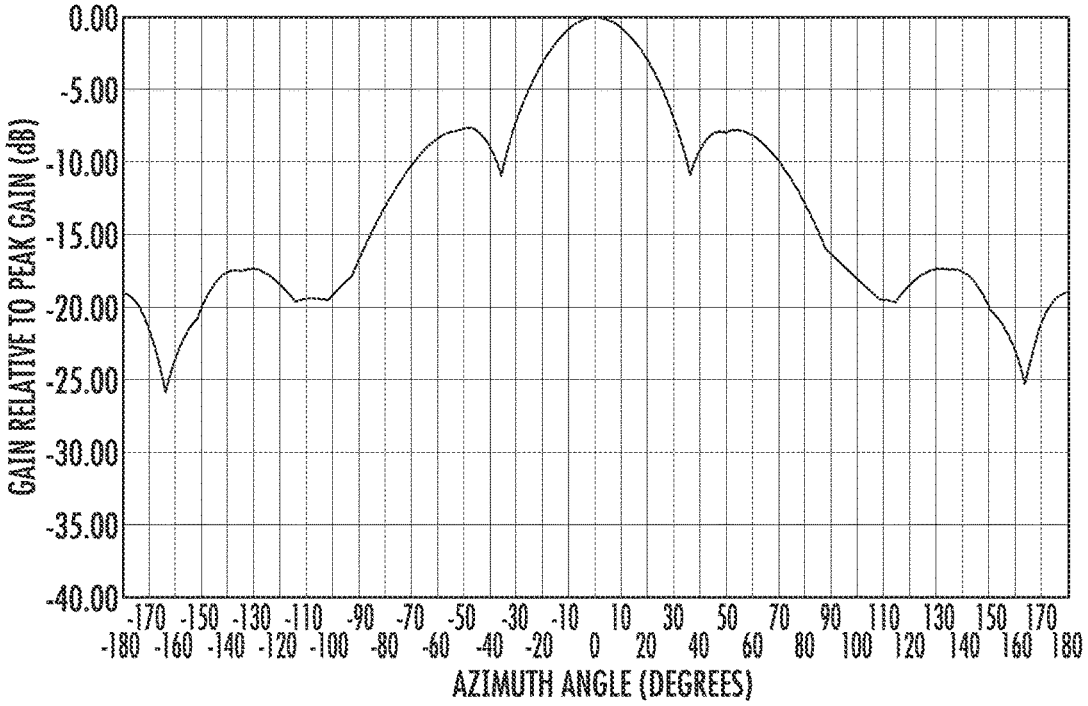
FIG. 2C is a graph of the envelope of the azimuth pattern for the base station antenna of FIG. 2A.

A known technique for narrowing the width of an antenna beam in the azimuth plane is to transmit the RF signal that generates the antenna beam through two spaced apart vertically-extending columns of radiating elements. FIGS. 2A and 2B schematically illustrate a base station antenna 200 having this design. As shown in FIGS. 2A and 2B, the base station antenna 200 may include the same longitudinally-extending V-shaped reflector 102 that was discussed above with reference to FIGS. 1A-1B. A first array 210-1 is mounted on the first panel 104-1, and a second array 210-2 is mounted on the second panel 204-2. The first array 210-1 includes columns 220-1, 220-2 of radiating elements 122, and the second array 210-2 includes columns 220-3, 220-4 of radiating elements 122. By transmitting each RF signal through arrays 210 that each include two side-by-side columns of radiating elements 122, the azimuth HPBW of the antenna beams can be reduced considerably, as shown in FIG. 2C. The amount that the azimuth HPBW is reduced is a function of the horizontal distance between the two columns 220 in each array 210. In order to achieve a suitable azimuth HPBW (for example, an azimuth HPBW of about 33°+/−5° for all frequencies in the operating frequency band and for the full range of electronic downtilts), the two arrays typically must be spaced fairly far apart (e.g., $1\lambda$, where $\lambda$ is the wavelength corresponding to the center frequency of the operating frequency band of the array). Unfortunately, this wide spacing tends to increase the magnitude of the sidelobes in the azimuth pattern, as can also be seen in FIG. 2C. Generally speaking, azimuth sidelobe levels should be at least 13 dB below the peak gain, and preferably at least 15 dB below the peak gain. In contrast, the azimuth sidelobe levels in FIG. 2C are only about 7.5 dB below peak gain. While these sidelobes may be reduced by moving the two columns 220 in each array 210 closer together, this will increase the azimuth HPBW to unacceptably high levels. Thus, the antenna design shown in FIGS. 2A-2B is also not suitable as a twin-beam base station antenna as it will generate antenna beams having azimuth sidelobe levels that are too high and/or an azimuth HPBW that is to wide.

Another issue with the base station antenna 200 is the elevation HPBW. The elevation HPBW for the antenna beams generated by an array that includes one or more columns of radiating elements is determined by the vertical spacing between the top and bottom radiating elements in the columns. As the vertical spacing is increased, the elevation HPBW is reduced. There are two constraints, however, on the vertical spacing. First, the vertical distance between the radiating elements in a given column of the array should be spaced apart by between about $0.6\lambda$ and $0.8\lambda$. If the radiating elements are spaced farther apart, the elevation sidelobes tend to get larger in the exact same manner that the azimuth sidelobes get larger as the columns of radiating elements are spaced farther apart horizontally. Thus, generally speaking, to increase the vertical spacing between the top and bottom radiating elements in the columns generally requires adding additional radiating elements, which increase the cost and weight of the antenna, or accepting higher elevation sidelobe levels. Second, base station antenna manufacturers typically only manufacture a few different types of phase shifter/power divider circuits, and these circuits only have a limited number of outputs (e.g., 3-7 outputs) in order to reduce the size thereof.

As shown in FIG. 2A, in the base station antenna 200, the radiating elements 122 in each array 210 are arranged in 2×1 sub-arrays 224 (i.e., each sub-array includes the two radiating elements 122 in each row of the array 210), and each sub-array 224 is connected to a respective output of a pair of phase shifter/power divider circuits (one for each polarization). If an antenna with such a design includes phase shifter/power divider circuits having seven outputs, then a total of seven radiating elements may be included in each column 220 of the arrays 210. This may not be enough radiating elements to maintain a proper vertical separation between the radiating elements while also achieving a sufficient vertical height for the column to achieve a desired elevation HPBW, and hence the elevation HPBW for the base station antenna 200 may be too large.

By connecting two radiating elements per column to each output of a phase shifter/power divider circuits, the number of radiating elements in each column may be increased to, for example, ten radiating elements (for a 1×5 phase shifter/power divider circuit) or to fourteen radiating elements (for a 1×7 phase shifter/power divider circuit). With this increase in the number of radiating elements per column, the elevation beamwidth can be narrowed to a suitable degree. However, even with ten radiating elements, it is necessary to space the radiating elements fairly far apart in the vertical direction to achieve desired elevation HPBW values (which are typically much smaller than the azimuth HPBW values).

Figure 3A:
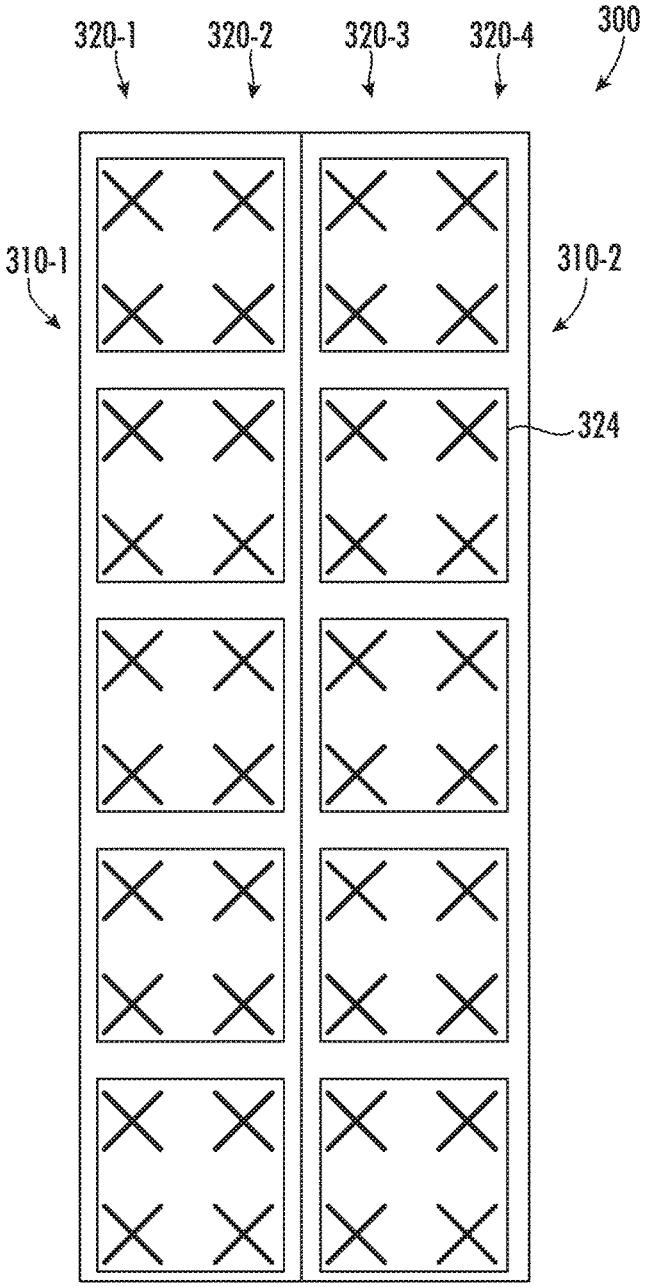
FIG. 3A is a schematic plan view of a twin-beam base station antenna having two columns of radiating elements that are fed as 2×2 rectangular sub-arrays mounted on each of the two major faces of a V-shaped reflector.
Figure 3B:
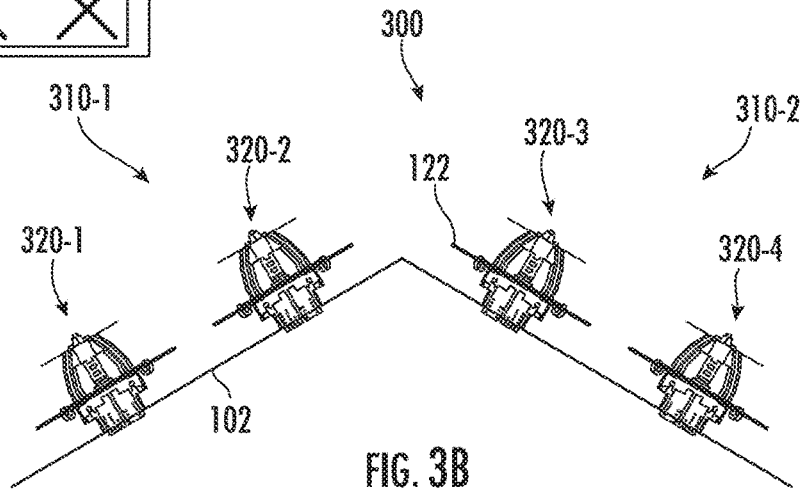
FIG. 3B is a schematic transverse cross-sectional view of the base station antenna of FIG. 3A.
Figure 3C:
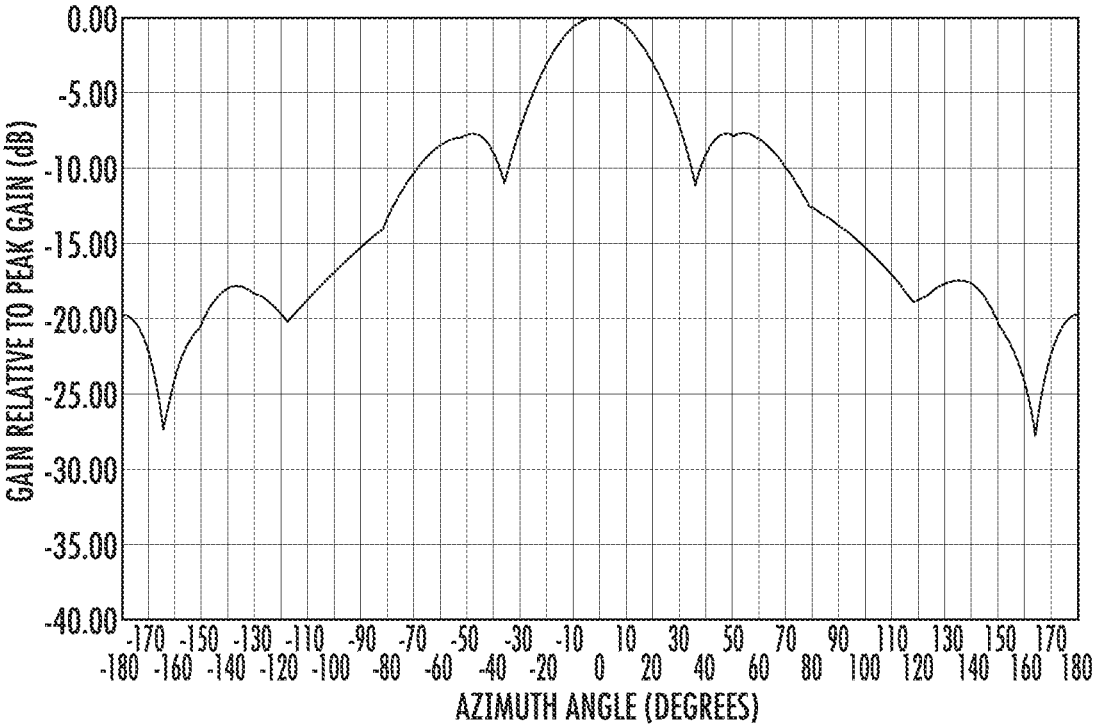
FIG. 3C is a graph of the envelope of the azimuth pattern for the base station antenna of FIG. 3A.
Figure 3D:
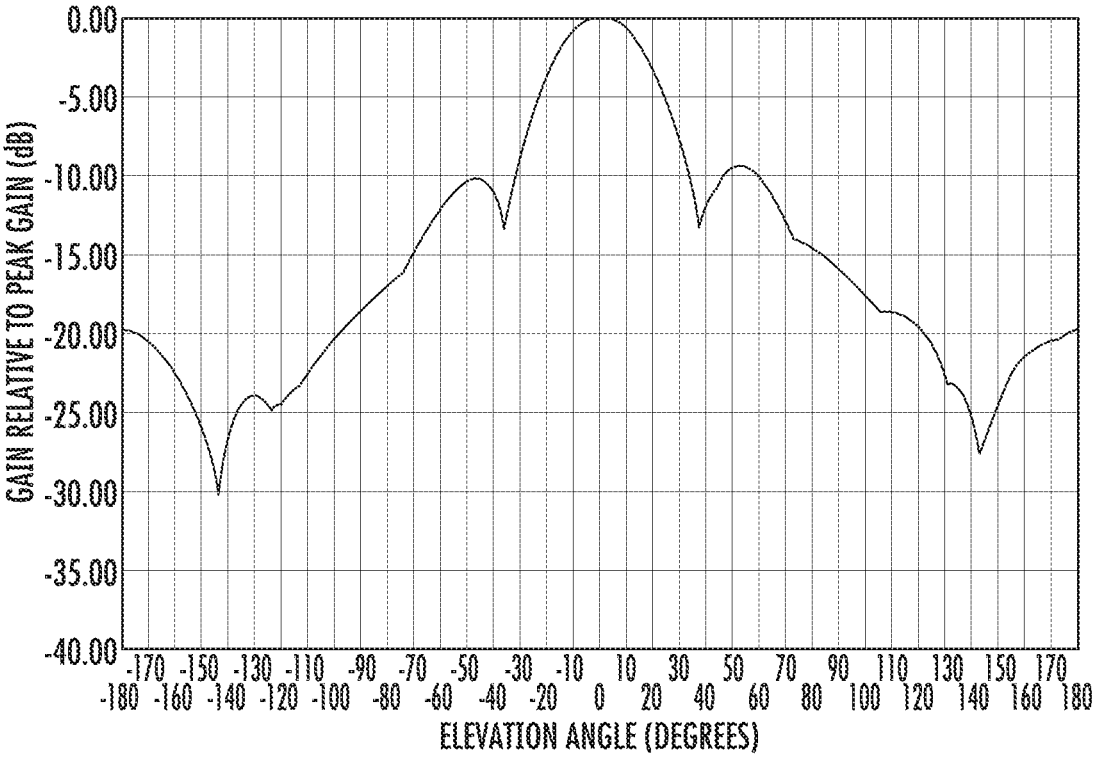
FIG. 3D is a graph of the envelope of the elevation pattern for the base station antenna of FIG. 3A.

In particular, FIGS. 3A-3B schematically illustrate a twin-beam base station antenna 300 that includes four columns 320-1 through 320-4 (in two arrays 310-1 and 310-2) of radiating elements 122. Each column 320 includes ten radiating elements 322 each, and the radiating elements 122 are again mounted on a V-shaped reflector (which has previously been described). The base station antenna 300 includes 1×5 phase shifter/power divider circuits, and hence a 2×2 sub-array 324 of radiating elements 122 is connected to each output of each phase shifter/power divider circuit. FIGS. 3C and 3D are simulated azimuth and elevation patterns for the base station antenna 300. As shown in FIG. 3C, the base station antenna 300 again exhibits high azimuth sidelobes, like the base station antenna 200 of FIGS. 2A-2B, which is expected given the similarities in the designs of base station antennas 200 and 300 in the horizontal plane. As shown in FIG. 3D, the base station antenna 300 also exhibits high elevation sidelobes. This results because it is necessary to space the radiating elements 122 fairly far apart in the elevation plane in order to meet the elevation HPBW requirements, and this increased spacing leads to high elevation sidelobes.

Figure 4A:
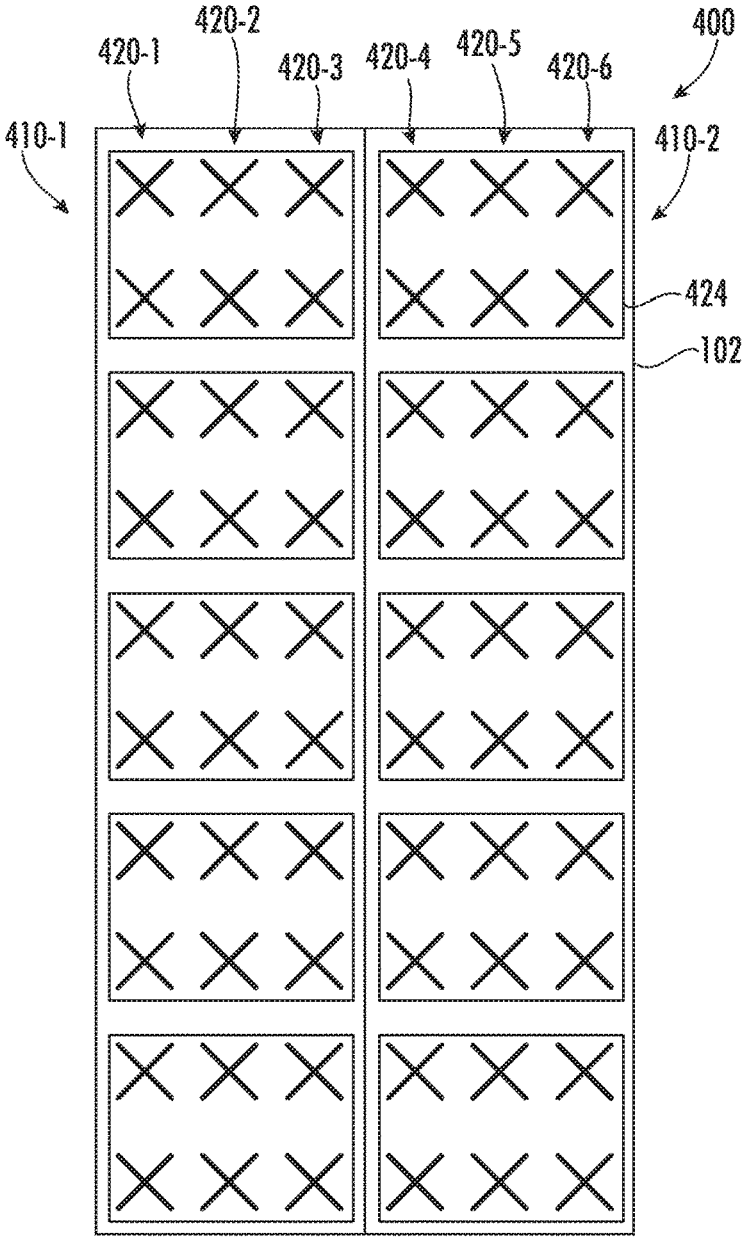
FIG. 4A is a schematic plan view of a twin-beam base station antenna having three columns of radiating elements that are fed as 3×2 rectangular sub-arrays mounted on each of the two major faces of a V-shaped reflector.
Figure 4B:
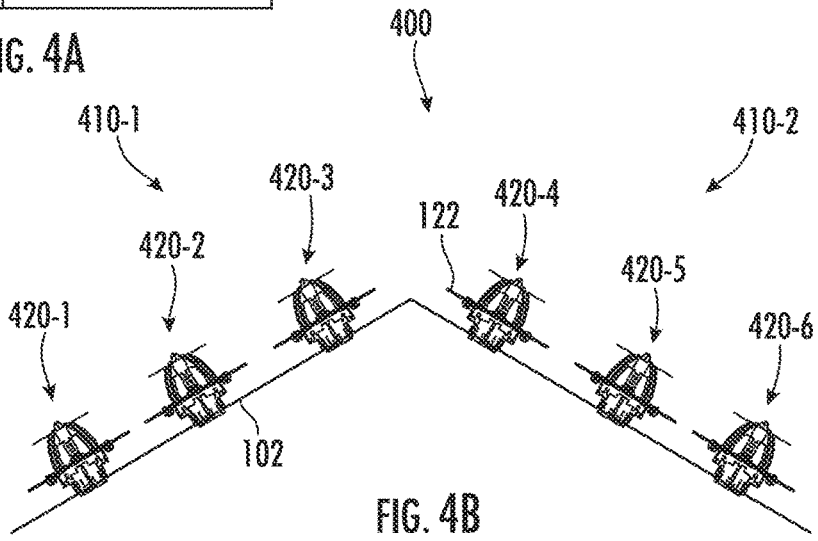
FIG. 4B is a schematic transverse cross-sectional view of the base station antenna of FIG. 4A.
Figure 4C:
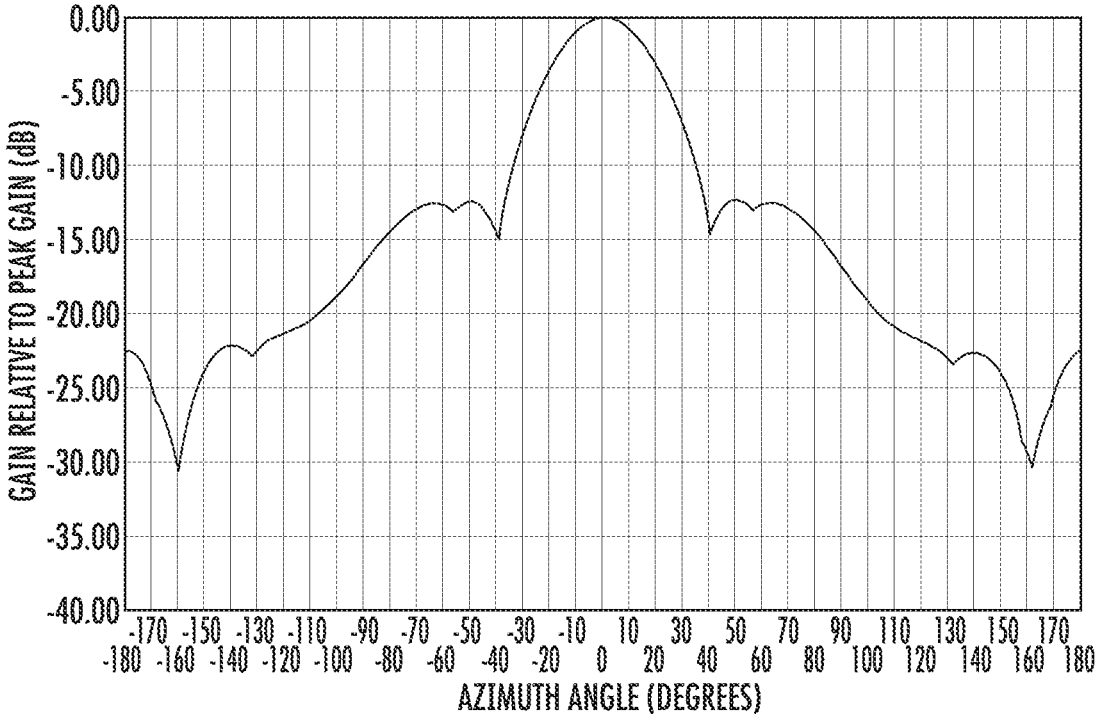
FIG. 4C is a graph of the envelope of the azimuth pattern for the base station antenna of FIG. 4A.
Figure 4D:
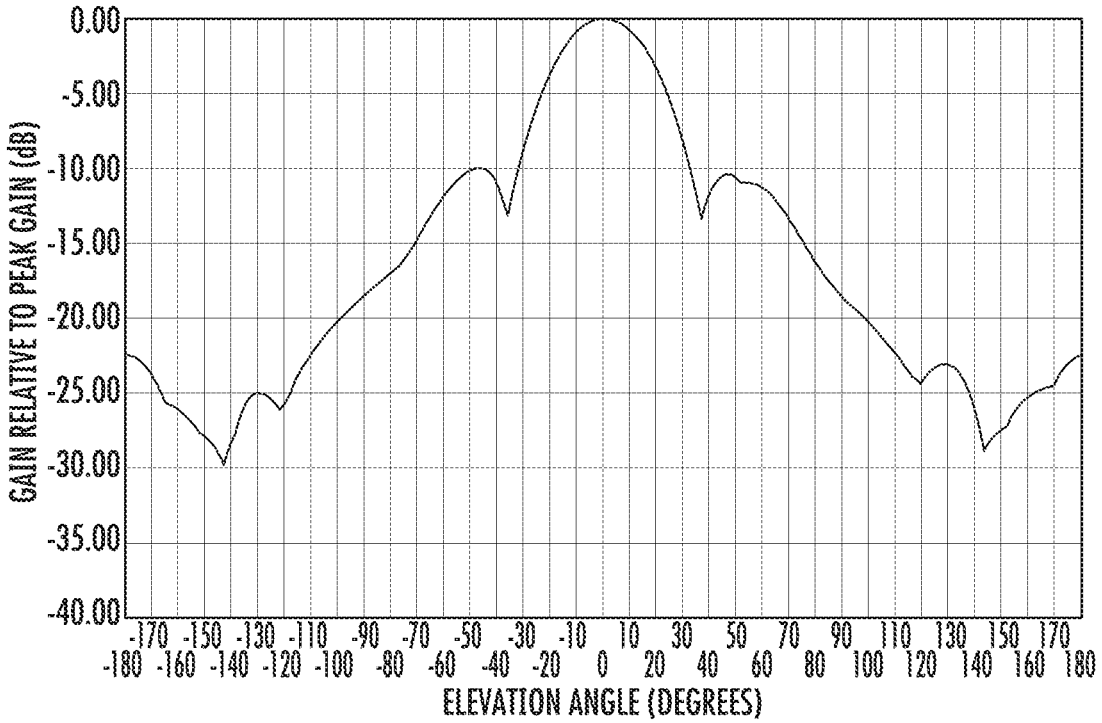
FIG. 4D is a graph of the envelope of the elevation pattern for the base station antenna of FIG. 4A.

As noted above, the high azimuth sidelobes exhibited by the base station antennas 200 and 300 can be attributed to the large spacing between adjacent radiating elements 122 in the horizontal direction, which is necessary to achieve sufficient narrowing of the azimuth HPBW. FIGS. 4A and 4B illustrate another twin-beam base station antenna 400 that adds a third column 420 of radiating elements 122 to each panel 104 of the reflector 102, which significantly reduces the horizontal spacing between adjacent radiating elements 122. As shown in FIGS. 4C and 4D, which are azimuth and elevation patterns for the base station antenna 400, the antenna 400 does exhibit reduced azimuth sidelobe levels, with the peak sidelobes being about 13 dB below the peak gain of the antenna pattern. While this performance is improved, it is still only at the edge of being acceptable. The azimuth sidelobe levels remain high for the base station antenna 400 due to poor isolation between adjacent columns 430 of radiating elements 122. This poor isolation occurs because the radiating elements 122 are too close together. The elevation sidelobes also remain too high (peaking at about 10 dB below peak gain), which results for the same reasons discussed above with respect to base station antenna 300. Additionally, the cross-polarization discrimination at boresight is also poor (about 10 dB below the co-polarization level), due to the close spacing of the radiating elements 122. Thus, even when the number of radiating elements 122 is increased to ten radiating elements 122 per column 420, and the number of columns 420 is increased to three per array 410, the performance of the base station antenna 400 is still not acceptable for many applications.

Figure 5A:
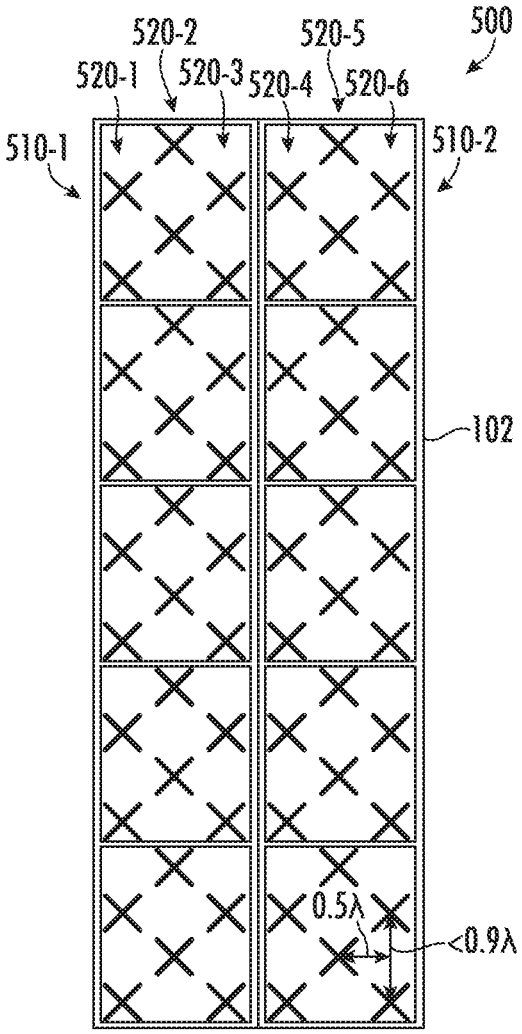
FIG. 5A is a schematic plan view of a twin-beam base station antenna having three columns of radiating elements that are fed as 3×2 offset rectangular sub-arrays mounted on each of the two major faces of a V-shaped reflector.
Figure 5B:
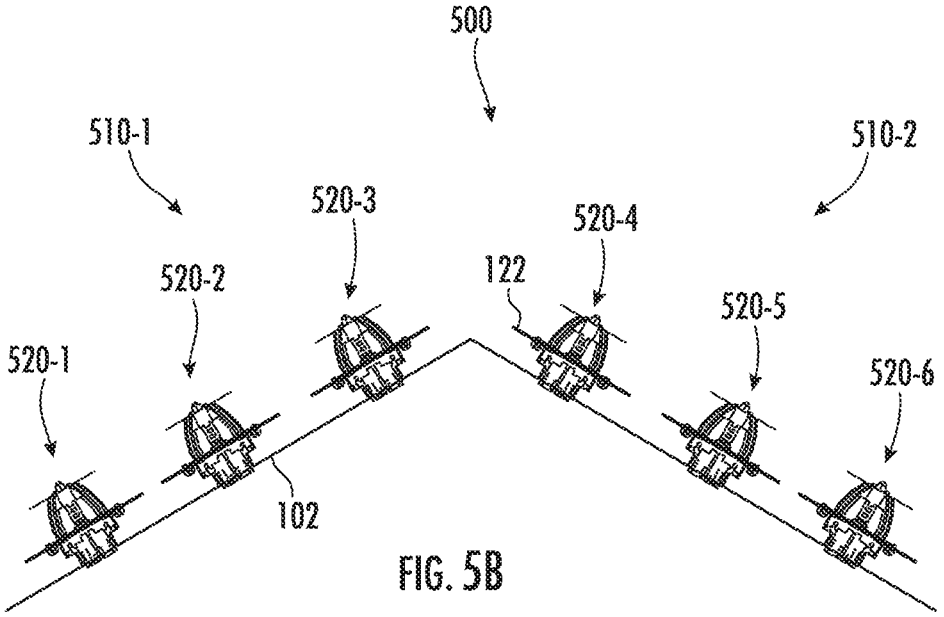
FIG. 5B is a schematic transverse cross-sectional view of the base station antenna of FIG. 5A.

FIGS. 5A-5B illustrate a conventional, state-of-the-art, non-lensed twin-beam base station antenna 500 that includes a V-shaped reflector 102 having three columns of radiating elements mounted on each panel 104 thereof. Base station antenna 500 differs from base station antenna 400 in that the center column 520-2, 520-5 of radiating elements 122 on each panel 104 is offset in the vertical direction from the other two columns 520-1, 520-3; 520-4, 520-6 of radiating elements 122. This offset increases the distance between radiating elements 122 in adjacent columns 520. The radiating elements 122 are arranged in offset 3×2 sub-arrays 524. As shown in FIG. 5A, the radiating elements 122 are spaced apart by less than 0.9λ (typically about 0.8λ) and adjacent columns 520 are separated by 0.5λ.

Figure 5C:
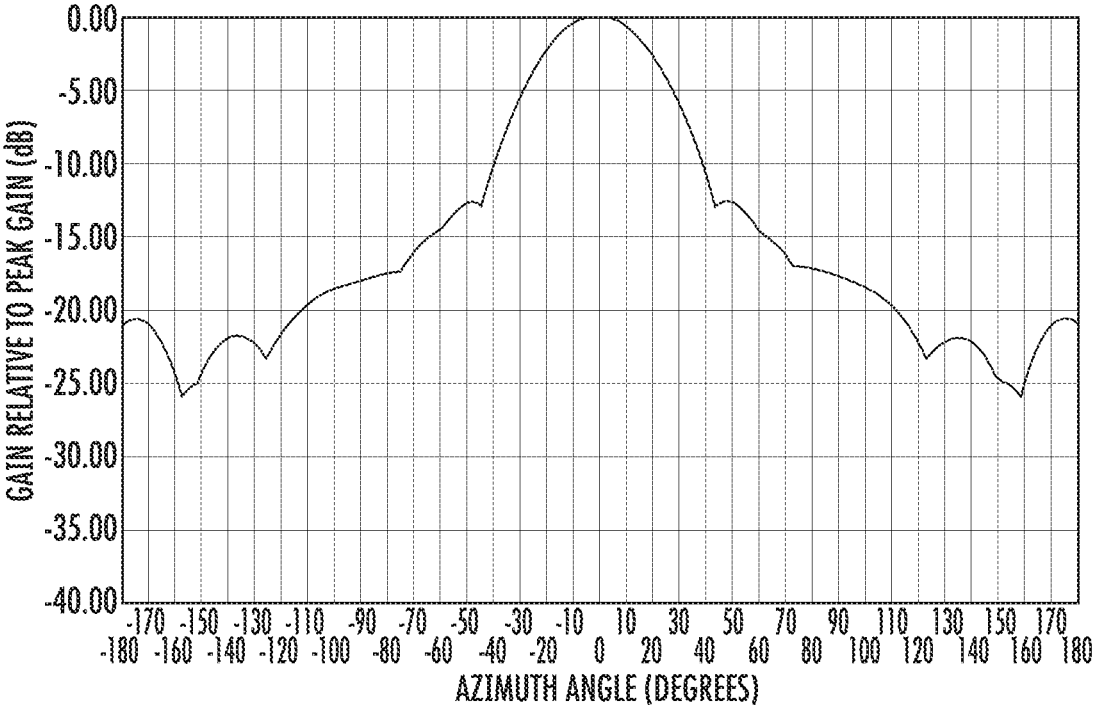
FIG. 5C is a graph of the envelope of the azimuth pattern for the base station antenna of FIG. 5A.
Figure 5D:
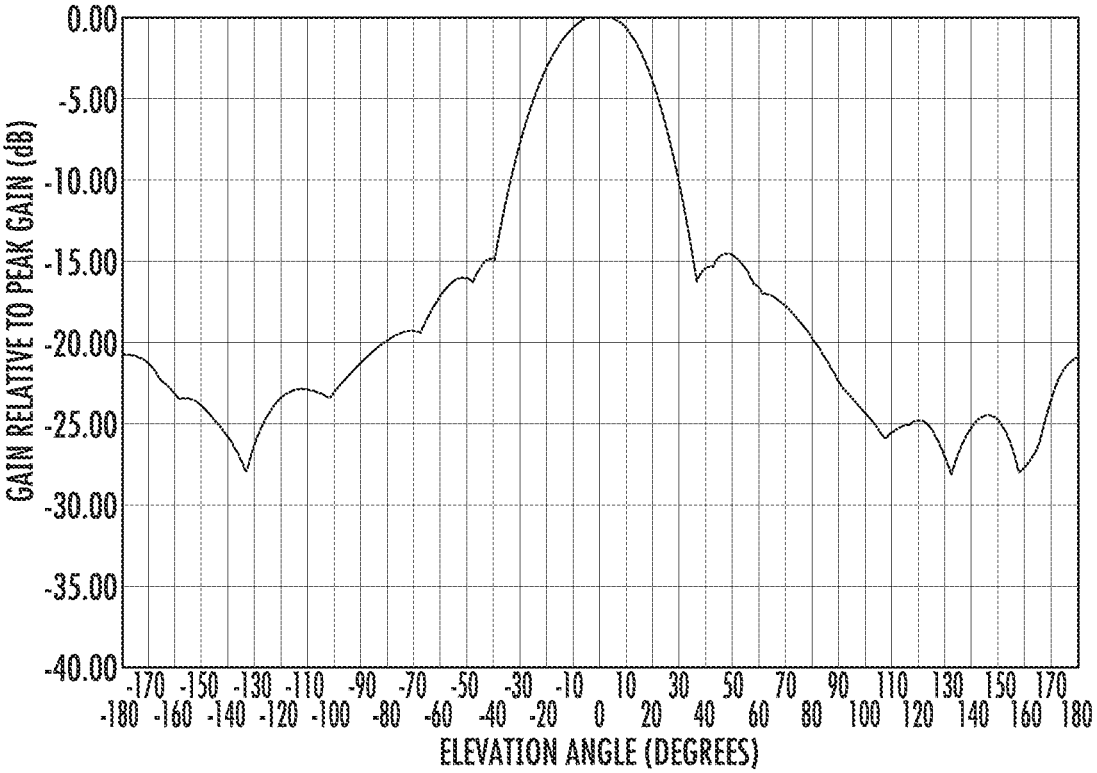
FIG. 5D is a graph of the envelope of the elevation pattern for the base station antenna of FIG. 5A.

By offsetting the center columns 520-2, 520-5 from the remaining columns 520, the spacing between adjacent radiating elements is increased. As shown in FIGS. 5C-5D, this acts to significantly reduce both the elevation sidelobe and cross-polarization levels such that both are well within the acceptable range. The azimuth sidelobe levels, however, are still about 13 dB below peak, which is at the edge of the acceptable range.

Pursuant to embodiments of the present invention, improved twin-beam base station antennas are provided that include first and second arrays of radiating elements that may be mounted on the respective first and second major panels of a generally V-shaped reflector. Each array includes three vertically-extending columns of radiating elements. The center column in each array is vertically offset from the outer columns in the array. The arrays are "thinned" in the vertical direction as compared to the prior art base station 500 of FIGS. 5A-5B in that they include fewer radiating elements per column. Most or all of the radiating elements in each array may be arranged in three radiating element sub-arrays that include a radiating element from each of the three columns in the array. The radiating elements in each of these sub-arrays may, therefore, be arranged in a triangular pattern. Each sub-array may be coupled to a respective output of a phase shifter/power divider circuit (for each polarization). In some embodiments, each sub-array may be mounted on a respective feed board that includes a power divider (for each polarization) that further splits the sub-component of the RF signal output by the respective output of the phase shifter/power divider circuit to feed all of the radiating elements in the sub-array with a portion of the RF signal output through the output of the phase shifter/power divider circuit.

The base station antennas according to embodiments of the present invention may include substantially fewer radiating elements as compared to the state-of-the-art twin-beam base station antenna 500 of FIGS. 5A-5B. For example, in some embodiments the twin-beam base station antennas according to embodiments of the present invention may include 30-33% fewer radiating elements than base station antenna 500. By thinning the arrays in the vertical direction, the vertical spacing between adjacent radiating elements is increased. Normally, this would be expected to increase the sidelobes in the elevation pattern, as explained in the discussion above. The skilled artisan would understand that such increased elevation sidelobe levels are undesirable. However, due to the reduced coupling between radiating elements in adjacent columns, which coupling can also contribute to increased elevation sidelobe levels, the base station antennas according to embodiments of the present invention may achieve comparable elevation sidelobe performance levels to the base station antenna 500 of FIGS. 5A-5B. Moreover, by increasing the vertical distance between adjacent radiating elements, the physical separation between radiating elements in adjacent columns is increased (reducing coupling). In fact, the increased physical separation between radiating elements may allow for the columns to be spaced together more closely in the horizontal direction. As a result of the decreased coupling and/or tighter horizontal column spacing, the azimuth sidelobe levels of the base station antennas according to embodiments of the present invention may be significantly improved as compared to the base station antenna 500. Moreover, the reduced horizontal spacing between columns may reduce the width of the antenna, which is also desirable, particularly in multiband antenna applications.

Figure 6A:
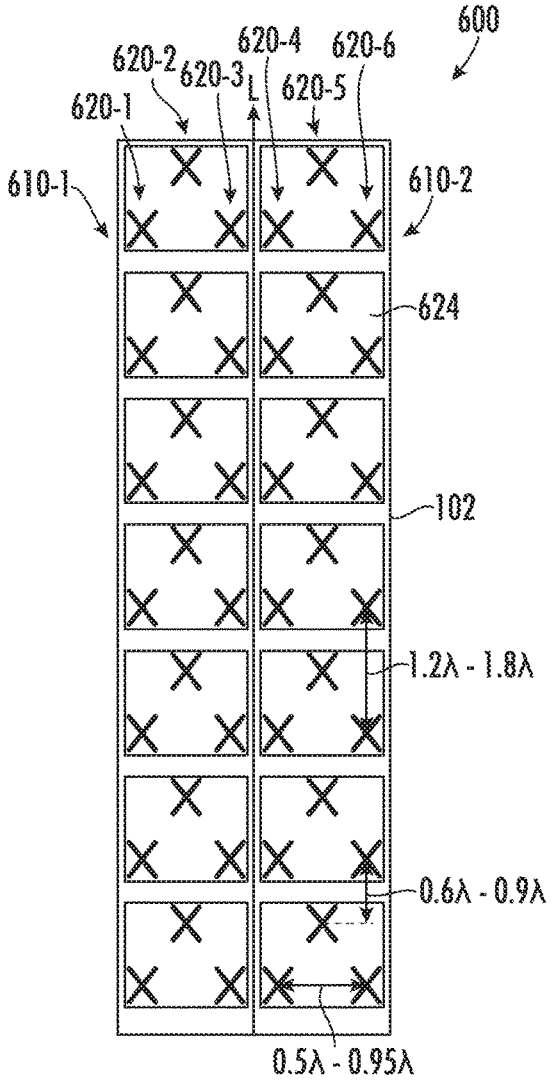
FIG. 6A is a schematic plan view of a twin-beam base station antenna according to embodiments of the present invention that has three columns of radiating elements that are fed as 3×1 triangular sub-arrays mounted on each of the two major faces of a V-shaped reflector.
Figure 6B:
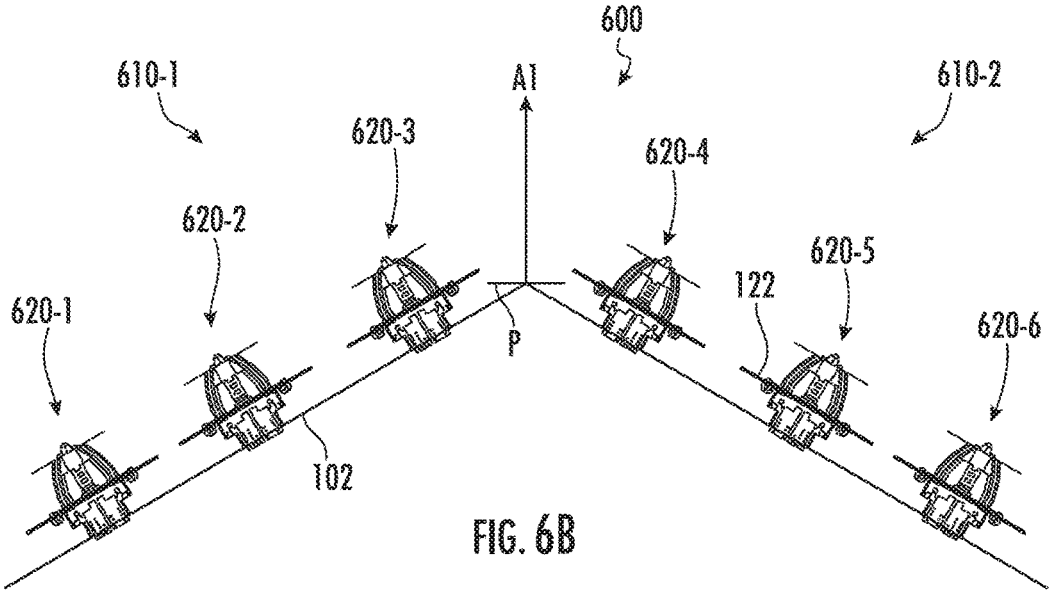
FIG. 6B is a schematic transverse cross-sectional view of the base station antenna of FIG. 6A.
Figure 6C:
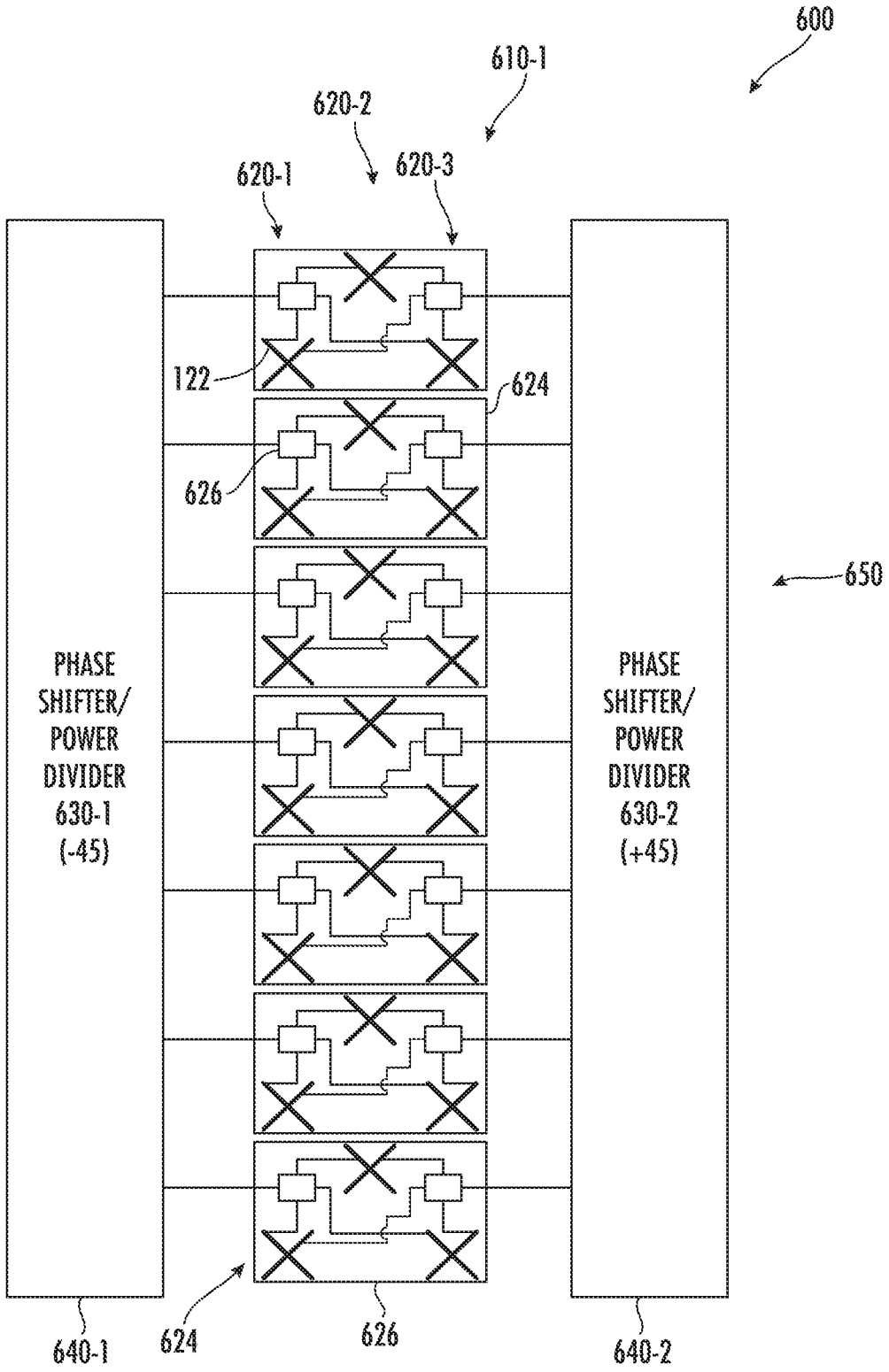
FIG. 6C is a block diagram of the feed network for the base station antenna of FIG. 6A.

FIGS. 6A-6C illustrate a twin-beam base station antenna 600 according to a first embodiment of the present invention. In particular, FIG. 6A is a schematic front view of the antenna 600 (with the radome removed) that illustrates the locations of the radiating elements and their arrangement into sub-arrays. FIG. 6B is a transverse cross-section of the base station 600 illustrating the positioning of the radiating elements on a V-shaped reflector. FIG. 6C is a block diagram illustrating the feed network for one of the arrays included in base station antenna 600.

As shown in FIGS. 6A-6B, the base station antenna 600 is an elongated structure that extends along a longitudinal axis L. When the base station antenna 600 is mounted for normal use, the longitudinal axis $A_1$ will typically extend along a vertical axis, although in some cases the base station antenna 600 may be tilted a few degrees from the vertical to impart a mechanical downtilt to the antenna beams formed by the base station antenna 600. As is further shown in FIG. 6A, the base station antenna 600 has a length L and a width W, as well as a depth. The azimuth boresight pointing direction of the base station antenna 600 refers to a horizontal axis $A_1$ extending from the base station antenna 600 to the center, in the azimuth plane, of the sector served by the base station antenna 600.

As shown in FIGS. 6A-6B, the twin-beam base station antenna 600 includes six columns 620-1 through 620-6 of radiating elements 122. Columns 620-1 through 620-3 mounted to extend forwardly from panel 104-1 of the reflector 102 to form a first multicolumn array 610-1, and columns 620-4 through 620-6 mounted to extend forwardly from panel 104-2 to form a second multicolumn array 610-2. The center column 620-2, 620-5 on each panel 104 is offset in the vertical direction from the other two columns 620 (in the depicted embodiment, the central columns 620-2, 620-5 are offset upwardly, but may be offset downwardly in other embodiments). Each column 620 includes a total of seven radiating elements 122. Thus, each array 610 only includes a total of twenty-one radiating elements 122, as compared to the thirty radiating elements 122 included in each array 510 of the base station antenna 500. The radiating elements 122 in each array 610 are arranged in triangular sub-arrays 624 that include one radiating element 122 from each column 620. Each sub-array 624 in an array 620 may be coupled to respective outputs of a pair of phase shifter/power divider circuits (namely one phase shifter/power divider circuit for each polarization), as will be discussed in greater detail below with reference to FIG. 6C.

As is further shown in FIG. 6A, the radiating elements 122 in each column 620 may be spaced apart significantly farther (i.e., in the vertical direction) than the radiating elements 122 in base station antenna 500. In particular, adjacent radiating elements 122 in a column 620 may be spaced apart 1.2λ to 1.8λ, as compared to a spacing of less than 0.9λ in the base station antenna 500. This increased spacing allows for the significant thinning of the number of radiating elements 122 included in each array 610 of base station antenna 600. While in some embodiments adjacent radiating elements 122 in a column 620 may be spaced apart by 1.2λ to 1.8λ, in other embodiments the spacing may be between 1.3λ to 1.7λ, or 1.4 to 1.6λ. Additionally, due to the increased spacing in the vertical direction, the outside columns 620 may be moved closer together (e.g., to between 0.5λ to 0.95λ, or between 0.6λ to 0.9λ, or between 0.7λ to 0.8λ) as compared to a spacing of 1λ in base station antenna 500.

Referring to FIG. 6C, the feed network 650 for one of the arrays 610 of radiating elements is schematically depicted. As shown in FIG. 6C, the antenna 600 includes a pair of RF ports 640-1, 430-2 that may be connected to respective ports on a remote radio head. The first RF port 640-1 may be for −45° polarization, and the second RF port 640-2 may be for the +45° polarization. The RF ports 640-1, 640-2 are coupled to respective phase shifter/power divider circuits 630-1, 630-2. In the depicted embodiment, each phase shifter/power divider circuit 630 is configured to split RF signals input thereto into five sub-components and to then apply an adjustable amount of phase taper across the five sub-components in order to electrically downtilt the resulting antenna beam by a desired amount. Each output of phase shifter/power divider circuit 630-1 is coupled to the slant −45° dipole radiators of the radiating elements 122 included in a respective one of the sub-arrays 624, and each output of phase shifter/power divider circuit 630-2 is coupled to the slant +45° dipole radiators of the radiating elements 122 included in a respective one of the sub-arrays 624. The three radiating elements 122 included in each sub-array 624 may be mounted on a respective sub-array feedboard 626, and a pair of 1×3 power dividers 628 (one for each polarization) may be included on the sub-array feedboard 626. Each 1×3 power divider 628 may further split the power of an RF signal received at the sub-array feedboard 626 to feed a portion thereof to each radiating element 122. The 1×3 power dividers 628 may equally or unequally split the power. In many cases, the 1×3 power dividers 628 may be configured to pass more power to the radiating element from the middle column 620-2, 620-5 than to the radiating elements from the outer columns 620. For example, in some embodiments, the 1×3 power dividers 628 may split the RF signals input thereto to provide more power to the radiating elements 122 in the center columns 620-2, 620-5 than to the radiating elements 122 in the outer columns 620-1, 620-3, 620-4, 620-6. In one example embodiment, the radiating elements 122 in the middle columns 620-2, 620-5 may receive between 40%-70% of the power input to each 1×3 power divider 628, with the remaining power being split between the radiating elements 122 in the outer columns 620-1, 620-3, 620-4, 620-6. For example, the radiating elements 122 in the middle columns 620-2, 620-5 may receive 50% of the power of an RF signal input to each 1×3 power divider 628, while the radiating elements 122 in the outer columns 620-1, 620-3, 620-4, 620-6 each receive 25% of the power of an RF signal input to each 1×3 power divider 628.

Figure 6D:
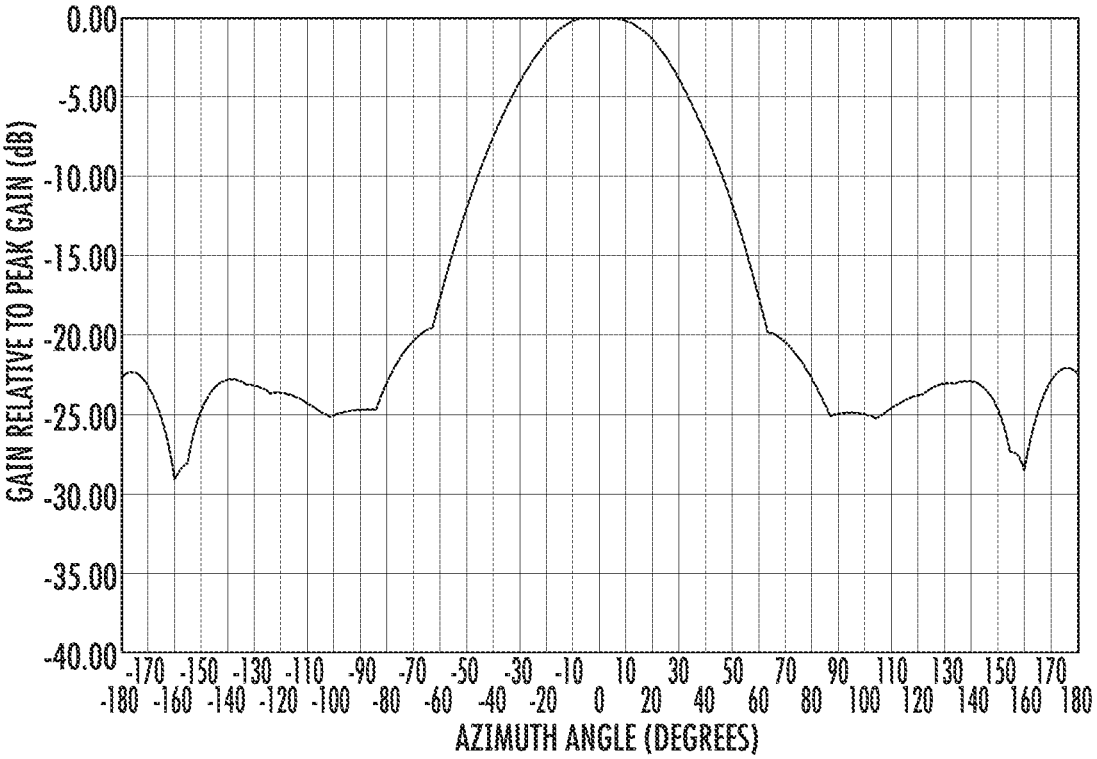
FIG. 6D is a graph of the envelope of the azimuth pattern for the base station antenna of FIG. 6A.
Figure 6E:
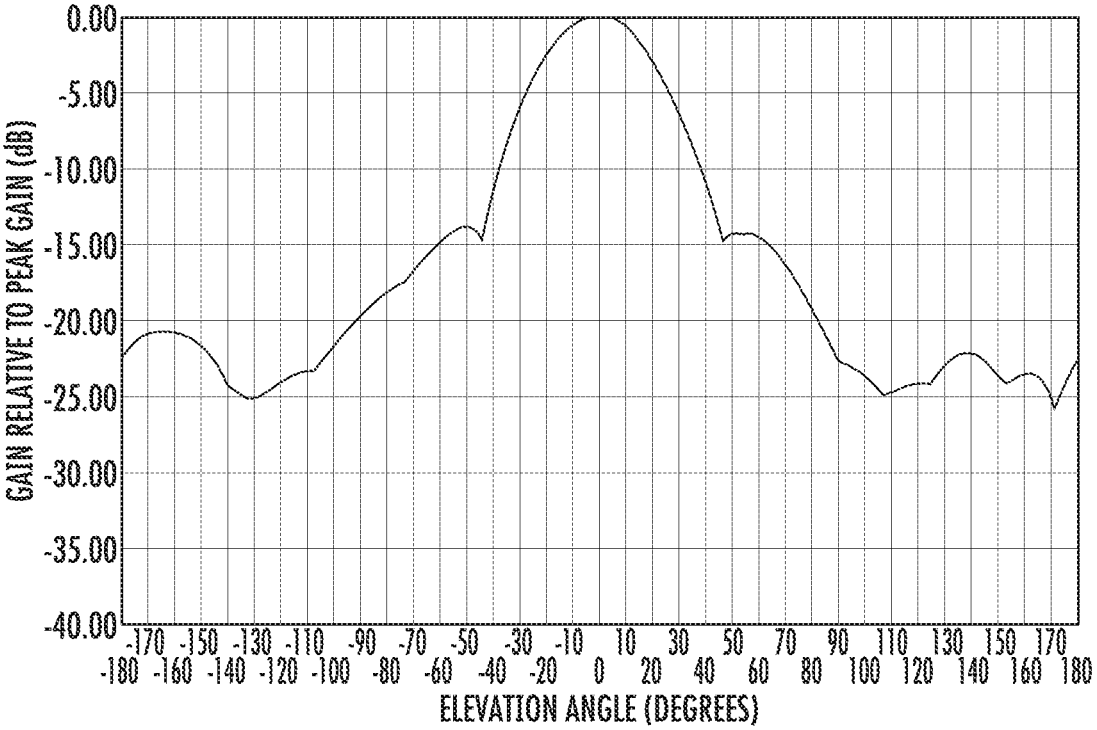
FIG. 6E is a graph of the envelope of the elevation pattern for the base station antenna of FIG. 6A.

FIGS. 6D and 6E are graphs of the simulated "envelopes" of the azimuth and elevation patterns for the base station antenna of FIGS. 6A-6C. A shown in FIG. 6D, the antenna beams generated by base station antenna 600 have a slightly larger azimuth HPBW as compared to the antenna beams generated by the base station antenna 500, but the azimuth HPBW is still within the acceptable range. Moreover, the antenna beams generated by base station antenna 600 have significantly reduced azimuth sidelobe levels, being at least 20 dB below peak gain. The elevation sidelobes of the antenna beams generated by are comparable to the elevation sidelobes of the antenna beams generated by base station antenna 500.

Simulations have been performed to analyze various performance parameters for the twin-beam base station antenna 600 of FIGS. 6A-6C. TABLE I below summarizes the results of these simulations. As shown, separate simulations were run for five different sub-bands in the 1695-2690 MHz cellular frequency band, with simulations being performed at multiple frequencies within each sub-band. The simulations were performed at electrical downtilt values of 0° and 12° in order to account for the effects of electrical downtilt on antenna performance.

TABLE I

| Specification | Sub-Band 1 1695-1880 MHz | Sub-Band 2 1850-1990 MHz | Sub-Band 3 1920-2180 MHz | Sub-Band 4 2300-2400 MHz | Sub-Band 5 2490-2690 MHz |
|---|---|---|---|---|---|
| Mean Azimuth HPBW (deg) | 38 | 35 | 34 | 31 | 29 |
| Azimuth HPBW Tolerance (deg) | +/−3.8 | +/−3.6 | +/−3.4 | +/−3.0 | +/−3.0 |
| 12 dB Azimuth BW (deg) | 73 | 68 | 65 | 59 | 55 |
| Azimuth Pointing Angle (deg) | +/−27 | +/−27 | +/−27 | +/−27 | +/−27 |
| Cross-Pol Ratio @ 0° (dB) | 13 | 15 | 15 | 15 | 15 |
| Cross-Pol Ratio - 10 dB BW (dB) | 24 | 27 | 27 | 28 | 28 |

As shown in TABLE I, the mean azimuth HPBW for each antenna beam generated by the base station antenna 600 is between 38° and 29°, with a variance of less than 4° within all five sub-bands. The 12 dB azimuth beamwidths, which range from 73°-55° are acceptable, and the azimuth pointing angle can be selected to be any desired value and will be the same across all sub-bands since the azimuth pointing angle is determined by the mechanical steering of the reflector. While not listed in TABLE I, the peak azimuth sidelobes are more than 15 dB below the peak gain across all sub-bands. The elevation sidelobes exceed −15 dB (see FIG. 6E) but are at least 14 dB below peak gain in all cases, which is acceptable. The cross-polarization discrimination performance is fully acceptable in all but the first sub-band. Thus, the simulated results shown in TABLE I indicate that the base station antenna 600 provides acceptable performance for a sector splitting application. The performance is at least comparable to the state-of-the-art conventional twin beam base station antenna 500, yet the base station antenna 600 includes far fewer radiating elements and may have a smaller width.

Figure 7A:
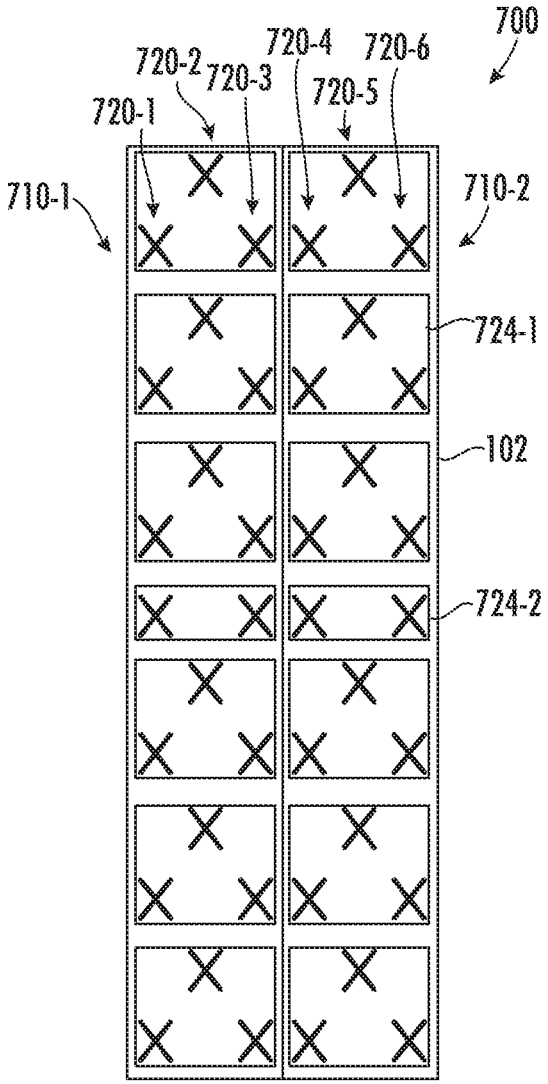
FIG. 7A is a schematic plan view of a twin-beam base station antenna according to further embodiments of the present invention.
Figure 7B:
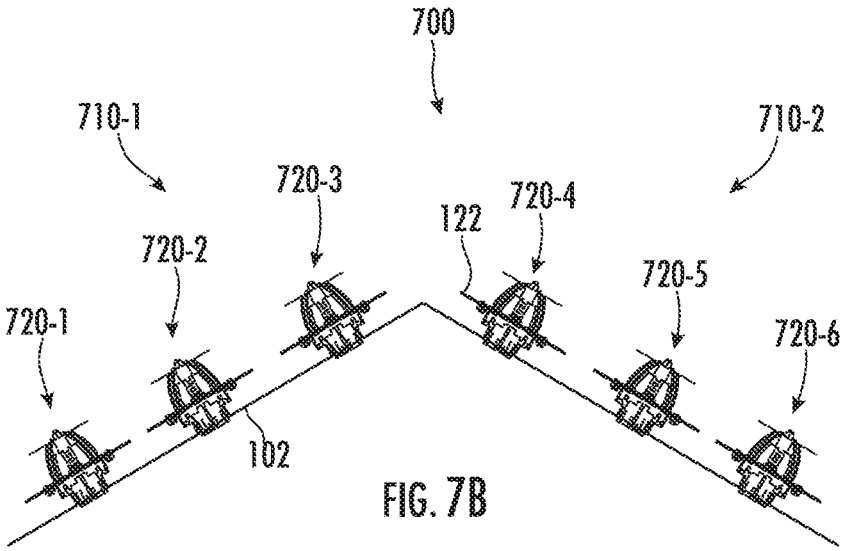
FIG. 7B is a schematic transverse cross-sectional view of the base station antenna of FIG. 7A.

FIG. 7A is a schematic front view of a twin-beam base station antenna 700 that is a modified version of the base station antenna 600 of FIGS. 6A-6C. FIG. 7B is a transverse cross-sectional view of the base station 700. As can be seen by comparing FIGS. 7A-7B to FIGS. 6A-6B, the base station antennas 600 and 700 are nearly identical to each other, with the primary difference being that the middle columns 720-2, 720-5 of radiating elements 122 in base statin antenna 700 only have six radiating elements 122 each as opposed to seven. Thus, the arrays 710-1, 710-2 included in base station antenna 700 only have twenty radiating elements 122 each as compared to the thirty radiating elements 122 included in each array 610 of base station antenna 600. As shown in FIG. 7A, the top three sub-arrays 724-1 and the bottom three sub-arrays 724-1 in each array 710 may be identical to the corresponding sub-arrays 624 in the base station antenna 600. However, the middle sub-array 724-2 in base station antenna 700 only includes two horizontally-aligned radiating elements 122. Despite having one less radiating element 122, the arrays 710 perform comparably to the arrays 610 of base station antenna 600.

Figure 8:
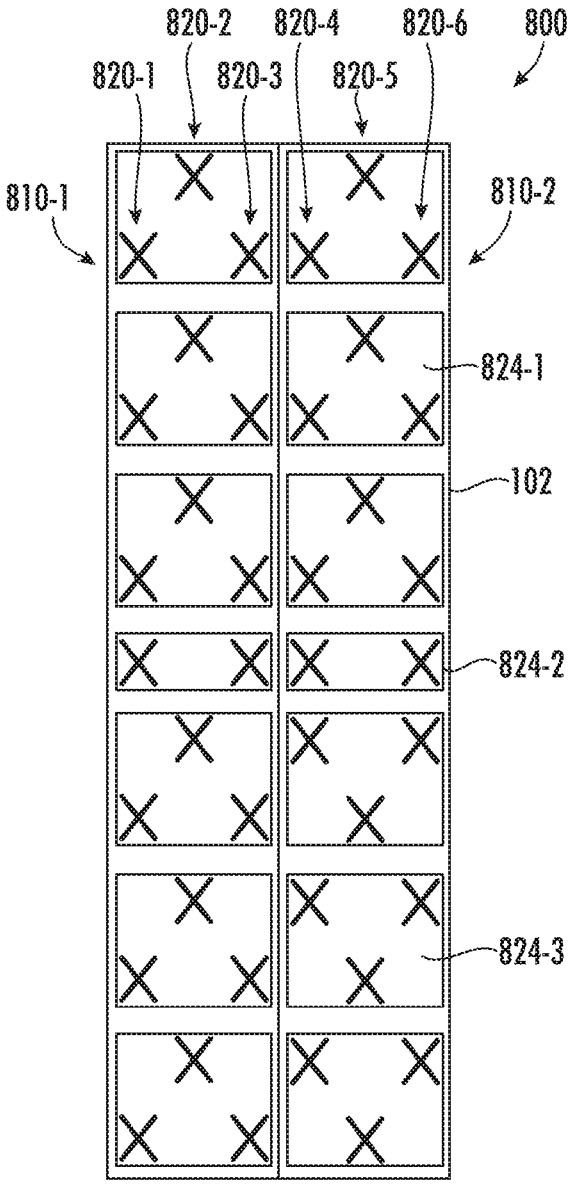
FIG. 8 is a schematic front view of a twin-beam base station antenna according to still further embodiments of the present invention.

FIG. 8 is a schematic front view of a twin-beam base station antenna 800 that is a modified version of the base station antenna 700 of FIGS. 7A-7C. As can be seen by comparing FIG. 8 to FIG. 7A, the base station antennas 800 and 700 are nearly identical to each other, with the primary difference being that the bottom three sub-arrays 824-3 in array 810-2 are flipped upside down with respect to the corresponding three sub-arrays 724-1 in array 710-2 of base station antenna 700. It will be appreciated that similar changes may be made to arrays 710-1 and 810-1, if desired, or that the top three sub-arrays could be inverted instead of and/or in addition to the bottom three sub-arrays in any of the sub-arrays in base station antennas 700 and/or 800.

Figure 9A:
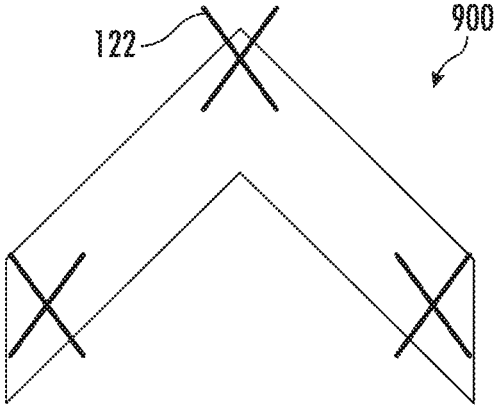
FIG. 9A is a schematic front view of a feedboard that may be used in the base station antennas according to embodiments of the present invention.
Figure 9B:
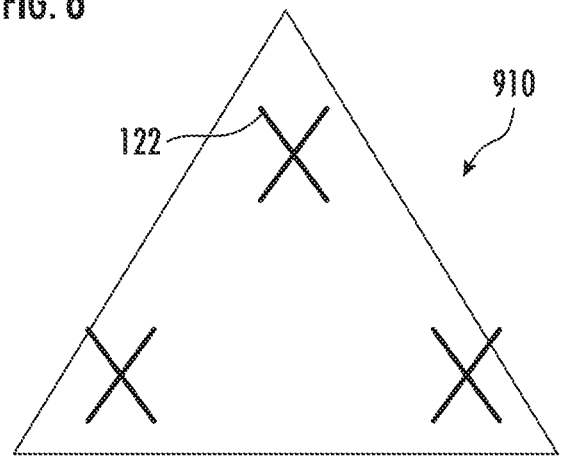
FIG. 9B is a schematic front view of another feedboard that may be used in the base station antennas according to embodiments of the present invention.

FIG. 9A is a schematic front view of a feedboard 900 that may be used to implement at least some of the feedboards in any of the base station antennas according to embodiments of the present invention. As shown in FIG. 9A, the feedboard 900 has a V-shaped design. Mounting locations for mounting radiating elements are provided near the vertex of the V and at the distal ends of the V. The mounting locations may define a triangle. The feedboard 900 may comprise a printed circuit board feed board that has a ground plane on a rear side thereof and conductive traces on a front side thereof. The 1×3 power divider circuits 628 included in the base station antennas according to embodiments of the present invention may also be formed on the front side of the printed circuit board. The 1×3 power divider circuits 628 may comprise, for example, three Wilkinson power dividers in some embodiments. The V-shaped feedboard design shown in FIG. 9A may be advantageous as it may allow a larger number of feedboards 900 to be manufactured from a given sized printed circuit board, thereby reducing costs. As shown in FIG. 9B, in other embodiments, feedboards 910 may be provided that have a triangular shape. The feedboards 910 typically require more printed circuit board material than the feedboards 910, and hence may cost more, but may also include additional room for implementing the 1×3 power divider circuits and a better shape for routing traces on the front side of the printed circuit board.

FIG. 10A is a transverse cross-sectional view of a twin-beam base station antenna 1000 according to embodiments of the present invention. In particular, the antenna 1000 includes (i) a high-band, twin-beam layout having first and second high-band arrays 1010-1 and 1010-2 and (ii) a low-band array 1030. The high-band arrays 1010-1 and 1010-2 may be on respective tilted portions (e.g., panels) 104-1 and 104-2 of a reflector 102 inside a radome 1011 of the antenna 1000, and the low-band array 1030 may be on a flat middle portion 104-M of the reflector 102 between, in a horizontal direction H, the tilted portions 104-1 and 104-2. The flat middle portion 104-M is coplanar with a horizontal plane HP, whereas the tilted portions 104-1 and 104-2 are tilted relative to the horizontal plane HP. In some embodiments, the radome 1011 may have a width W that does not exceed 395 millimeters ("mm") in the horizontal direction H.

The high-band array 1010-1 may include a first plurality of vertical columns 1020 of high-band radiating elements 122, and the high-band array 1010-2 may include a second plurality of vertical columns 1020 of high-band radiating elements 122. For example, the array 1010-1 may include three high-band vertical columns 1020-1, 1020-2, and 1020-3, and the array 1010-2 may include another three high-band vertical columns 1020-4, 1020-5, and 1020-6. Moreover, the low-band array 1030 may be a single vertical column of low-band radiating elements 1021. In some embodiments, the term "high-band" refers to a frequency band including 1695-2690 MHz or a portion thereof, and the term "low-band" refers to a frequency band including 694-960 MHz or a portion thereof.

FIG. 10B is a transverse cross-sectional view of a twin-beam base station antenna 1000R according to embodiments of the present invention. The antenna 1000R, like the antenna 1000 (FIG. 10A), includes the low-band array 1030 that is integrated between the high-band arrays 1010-1 and 1010-2. Unlike the antenna 1000, however, the antenna 1000R includes a reflector 102R that has a recessed flat middle portion 104-RM. Because the low-band array 1030 is on the recessed flat middle portion 104-RM, RF performance of the antenna 1000R may exceed that of the antenna 1000, as low-band radiating elements 1021 may "see" more of the reflector 102R than they would of the reflector 102 (FIG. 10A). Moreover, low-band radiating elements 1021 on the recessed flat middle portion 104-RM may not protrude as far in a forward direction F beyond high-band radiating elements 122 (FIG. 10A), and the antenna 1000R may thus be smaller than the antenna 1000.

The recessed flat middle portion 104-RM has a depth D that is spaced apart, in the forward direction F, from the horizontal plane HP. For example, the depth D may be 20-40 mm. Moreover, the tilted portions 104-1 and 104-2 have respective ends (e.g., end points) 104-1E and 104-2E that are adjacent each other and are in, or nearly in, the horizontal plane HP. Accordingly, the recessed flat middle portion 104-RM may be recessed relative to the ends 104-1E and 104-2E by approximately 20-40 mm. As shown in FIG. 10B, the tilted portions 104-1 and 104-2 may slope toward each other along the forward direction F toward a front side of the radome 1011.

By integrating low-band radiating elements 1021 with high-band radiating elements 122 on the reflector 102R (or 102), the antenna 1000R (or 1000) may provide an azimuth beamwidth (e.g., HPBW) of, for example, about 65° in a low frequency band, in addition to a twin-beam azimuth beamwidth (e.g., HPBW) of about 33° in a high frequency band. Moreover, the reflector 102R (or 102) may be tilted and shaped to improve beam-to-beam isolation for the twin-beam layout. For example, the tilt of the tilted portions 104-1 and 104-2, as well as the increased spacing between the tilted portions 104-1 and 104-2 due to the recessed flat middle portion 104-RM (or the flat middle portion 104-M), can reduce coupling between the high-band arrays 1010-1 and 1010-2.

In some embodiments, the high-band arrays 1010-1 and 1010-2 may each have triangular sub-arrays mounted on the reflector 102R (or 102). Such triangular arrangements of high-band radiating elements 122 can reduce costs by using fewer radiating elements 122 than conventional arrangements, and can decrease coupling between radiating elements 122 and improve space utilization in the antenna 1000R (or 1000).

Figure 10C:
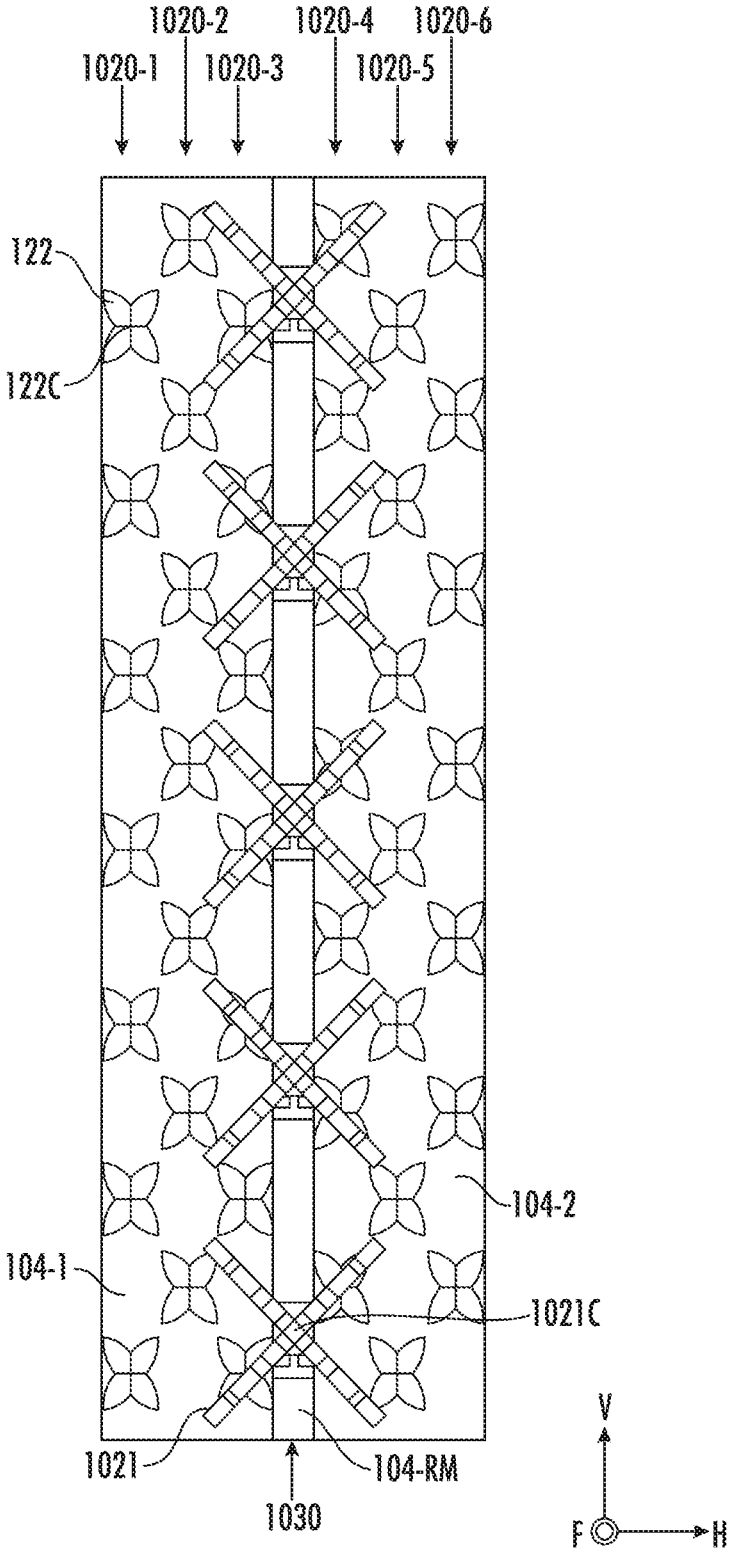
FIGS. 10C and 10D are schematic front views of the base station antenna of FIG. 10B.
Figure 10D:
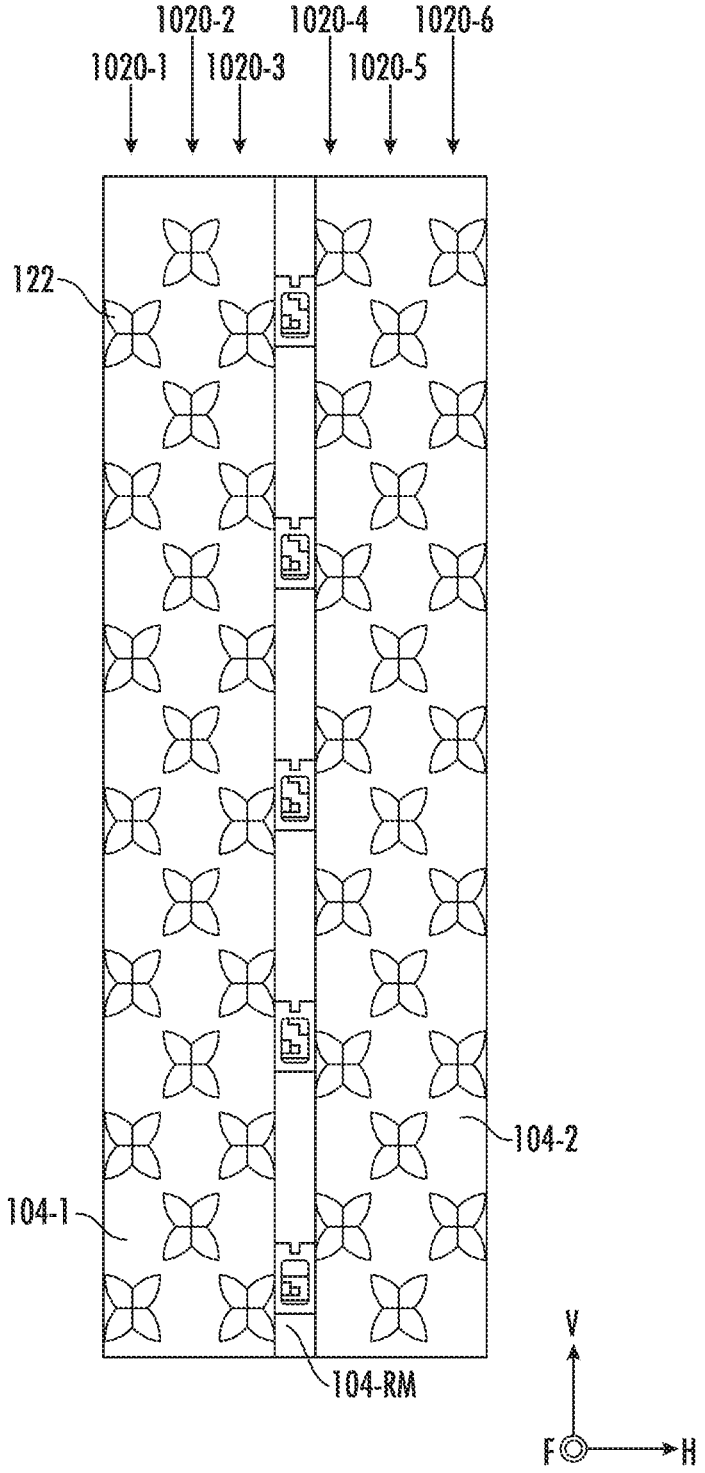

FIGS. 10C and 10D are schematic front views of the base station antenna 1000R of FIG. 10B with the radome 1011 removed. For simplicity of illustration, the low-band array 1030 is omitted from view in FIG. 10D. As shown in FIGS. 10C and 10D, the high-band vertical columns 1020 may be vertically staggered in a vertical direction V, which may be perpendicular to both the forward direction F and the horizontal direction H. Staggering consecutive ones of the high-band vertical columns 1020 may advantageously improve isolation therebetween by increasing the distance between adjacent radiating elements 122.

For example, consecutive ones of the high-band vertical columns 1020-1, 1020-2, and 1020-3 may be vertically staggered relative to each other, and consecutive ones of the high-band vertical columns 1020-4, 1020-5, and 1020-6 may be vertically staggered relative to each other. Accordingly, the high-band vertical column 1020-2 may be vertically staggered relative to the high-band vertical columns 1020-1 and 1020-3, and the high-band vertical column 1020-5 may be vertically staggered relative to the high-band vertical columns 1020-4 and 1020-6.

Moreover, the array 1010-1 (FIG. 10B) may have a first triangular arrangement in which each radiating element 122 of the high-band vertical column 1020-2 defines a triangle shape with nearest respective radiating elements 122 of the high-band vertical columns 1020-1 and 1020-3, and the array 1010-2 (FIG. 10B) may have a second triangular arrangement in which each radiating element 122 of the high-band vertical column 1020-5 defines a triangle shape with nearest respective radiating elements 122 of the high-band vertical columns 1020-4 and 1020-6. The second triangular arrangement may be inverted relative to the first triangular arrangement. Accordingly, the high-band vertical columns 1020-3 and 1020-4, which may be innermost (i.e., closest to the recessed flat middle portion 104-RM) high-band vertical columns 1020 on their respective tilted portions 104-1 and 104-2, may be vertically staggered relative to each other. This may advantageously improve isolation between innermost radiating elements 122 on opposite sides of the recessed flat middle portion 104-RM. Also, the high-band vertical column 1020-2 may be aligned in the horizontal direction H with the high-band vertical columns 1020-4 and 1020-6, and the high-band vertical column 1020-5 may be aligned in the horizontal direction H with the high-band vertical columns 1020-1 and 1020-3.

Each high-band radiating element 122 may have a respective center point 122C (FIG. 10C). Similarly, each low-band radiating element 1021 may have a respective center point 1021C (FIG. 10C). Accordingly, the term "aligned," as used herein with respect to vertical column(s) of radiating elements 122 and/or vertical column(s) of radiating elements 1021, may refer to alignment of center points 122C and/or center points 1021C. Similarly, the term "staggered," as used herein with respect to vertical column(s) of radiating elements 122 and/or vertical column(s) of radiating elements 1021, may refer to stagger of center points 122C and/or center points 1021C. Moreover, as shown in FIG. 10C, respective center points 1021C of the radiating elements 1021 may not be aligned in the horizontal direction H with respective center points 122C of any of the radiating elements 122.

Figure 11A:
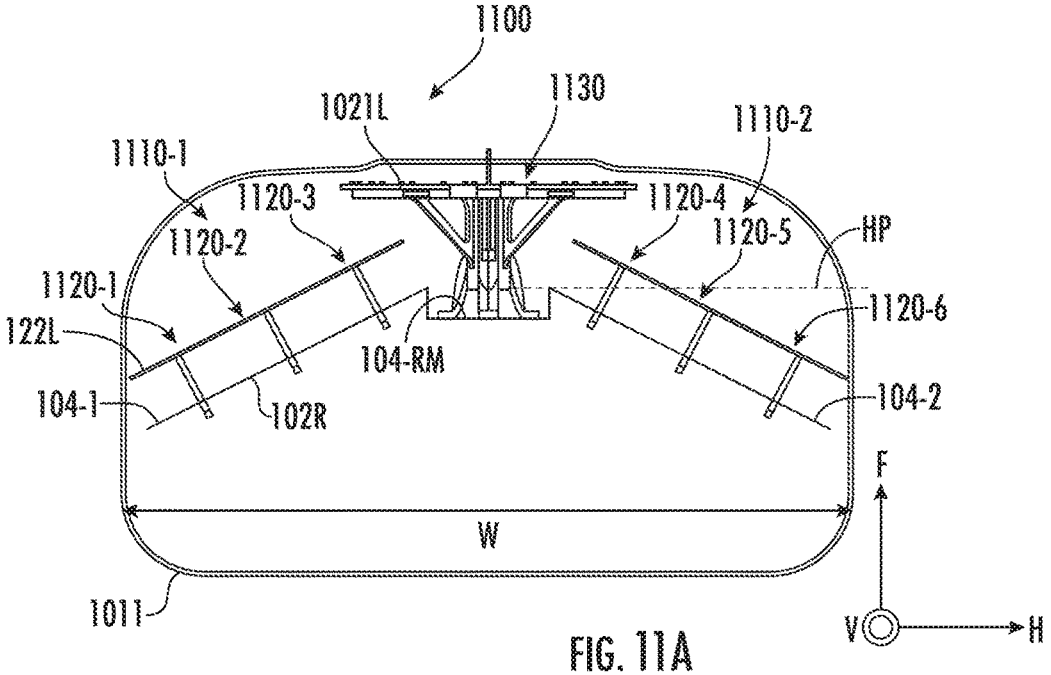
FIG. 11A is a transverse cross-sectional view of a twin-beam base station antenna according to embodiments of the present invention.

FIG. 11A is a transverse cross-sectional view of a twin-beam base station antenna 1100 according to embodiments of the present invention. Similar to the base station antenna 1000R (FIG. 10B), the antenna 1100 may include a reflector 102R that has first and second tilted portions 104-1 and 104-2 and a recessed flat middle portion 104-RM that is between, and recessed relative to respective adjacent ends 104-1E and 104-2E (FIG. 10B) of, the tilted portions 104-1 and 104-2. Compared with the antenna 1000R, however, the antenna 1100 may include high-band radiating elements 122L that have a lower cost and/or a smaller size than the radiating elements 122 (FIG. 10B). Additionally or alternatively, the antenna 1100 may include low-band radiating elements 1021L that have a lower cost and/or a smaller size than radiating elements 1021 (FIG. 10B).

In particular, the antenna 1100 may have a first high-band array 1110-1 that includes a first plurality of vertical columns 1120 of radiating elements 122L on the tilted portion 104-1, and a second high-band array 1110-2 that includes a second plurality of vertical columns 1120 of radiating elements 122L on the tilted portion 104-2. Each radiating element 122L may be a low-cost, sheet-metal dipole. Moreover, the antenna 1100 may have a low-band array 1130, which may be a vertical column of radiating elements 1021L on the recessed flat middle portion 104-RM, and each radiating element 1021L may be a low-cost, sheet-metal dipole. By using sheet metal on, for example, a plastic frame, a low-cost and relatively-compact dipole may be provided. As the size of the radiating elements 122L, and/or the size of the radiating elements 1021L, decreases, mutual coupling may also decrease, thus resulting in improved RF performance of the antenna 1100.

Figure 11B:
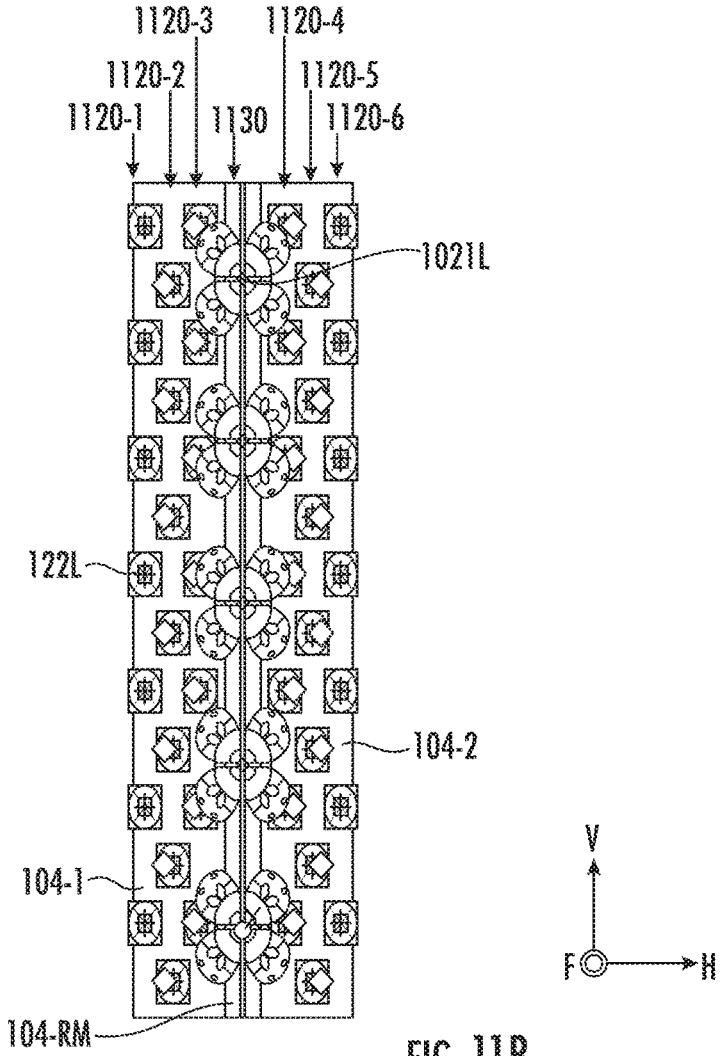
FIG. 11B is a schematic front view of the base station antenna of FIG. 11A.

FIG. 11B is a schematic front view of the base station antenna 1100 of FIG. 11A with the radome 1011 removed. Because the antenna 1100 may have reduced mutual coupling between its radiating elements 122L due to their size, a first triangular arrangement of the array 1110-1 (FIG. 11A) may not be inverted relative to (but rather may replicate) a second triangular arrangement of the array 1110-2 (FIG. 11A), as the recessed flat middle portion 104-RM that is between these two triangular arrangements may provide sufficient isolation therebetween.

Figure 12A:
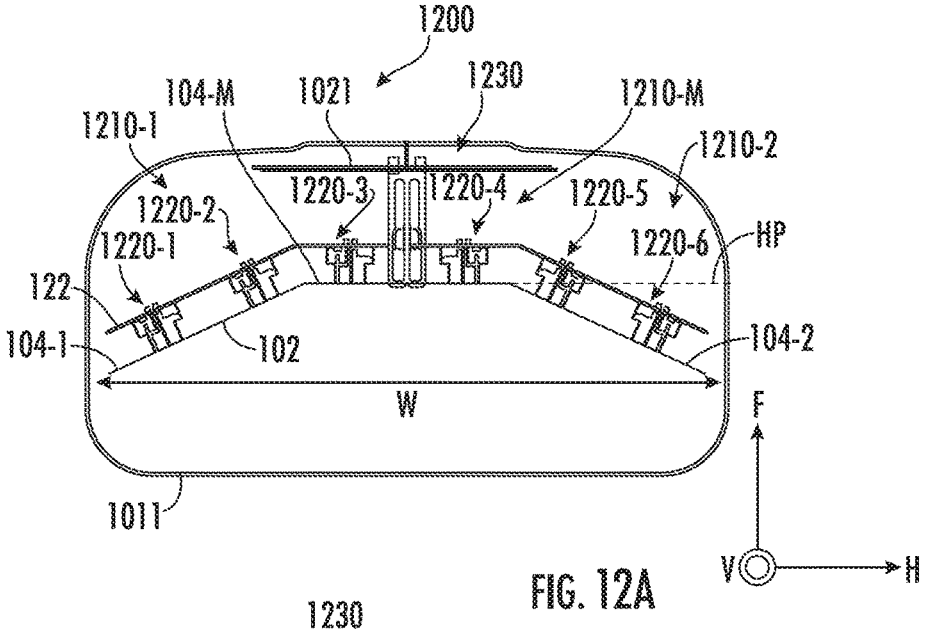
FIG. 12A is a transverse cross-sectional view of a twin-beam base station antenna according to embodiments of the present invention.

FIG. 12A is a transverse cross-sectional view of a twin-beam base station antenna 1200 according to embodiments of the present invention. Similar to the base station antenna 1000 (FIG. 10A), the antenna 1200 may include a reflector 102 that has first and second tilted portions 104-1 and 104-2 and a flat middle portion 104-M that is between the tilted portions 104-1 and 104-2. In contrast with the antenna 1000, however, the antenna 1200 may include high-band radiating elements 122 on the flat middle portion 104-M. For example, a first high-band region 1210-1 of the antenna 1200 may include vertical columns 1220-1 and 1220-2 on the tilted portion 104-1, a second high-band region 1210-2 of the antenna 1200 may include vertical columns 1220-5 and 1220-6 on the tilted portion 104-2, and a middle, third high-band region 1210-M of the antenna 1200 may include vertical columns 1220-3 and 1220-4 on the flat middle portion 104-M.

Figure 12B:
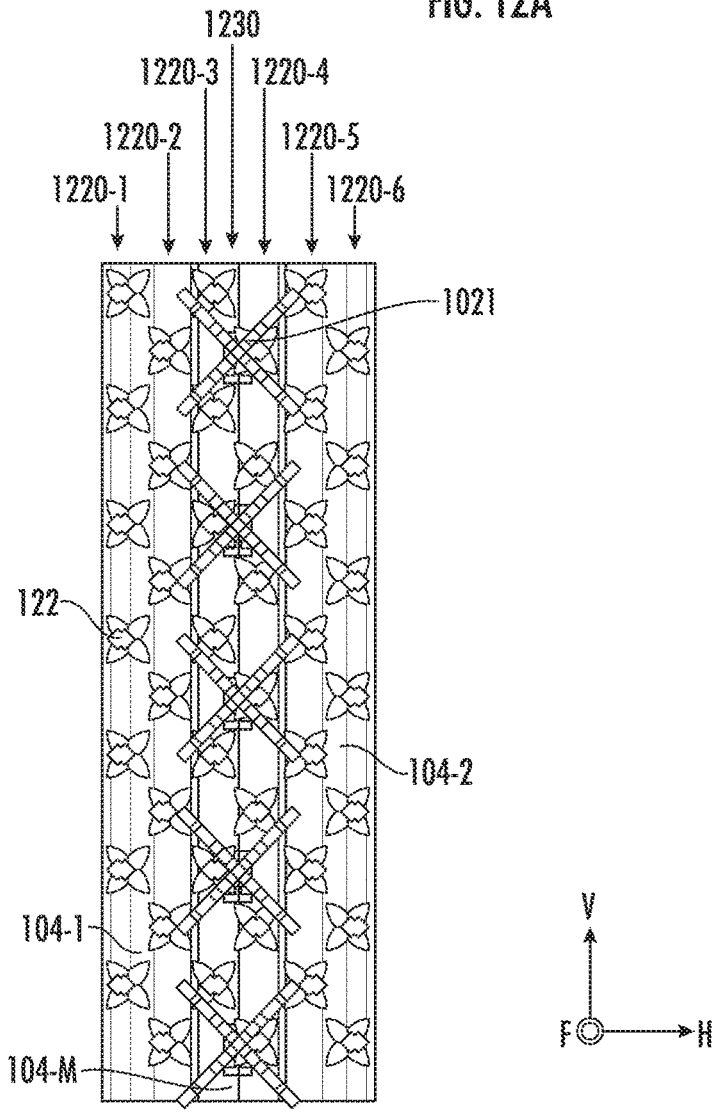
FIG. 12B is a schematic front view of the base station antenna of FIG. 12A.

FIG. 12B is a schematic front view of the base station antenna 1200 of FIG. 12A with the radome 1011 removed. As shown in FIG. 12B, each of the regions 1210-1, 1210-2, and 1210-M may include vertically-staggered vertical columns 1220. In some embodiments, the leftmost vertical column 1220-3 in the region 1210-M may be staggered relative to the rightmost vertical column 1220-2 in the region 1210-1, and the rightmost vertical column 1220-4 in the region 1210-M may be staggered relative to the leftmost vertical column 1220-5 in the region 1210-2. Moreover, the vertical column 1220-1 may be aligned in the horizontal direction H with the vertical column 1220-3 and the vertical column 1220-5, and the vertical column 1220-2 may be aligned in the horizontal direction H with the vertical column 1220-4 and the vertical column 1220-6. As a result, each radiating element 122 may define a triangle shape with two adjacent radiating elements 122 that are in adjacent vertical columns 1220. The replication of these triangle shapes throughout the antenna 1200 may maintain wide spacing between radiating elements 122, and thus may reduce mutual coupling therebetween.

To achieve an azimuth beamwidth of about 33° in a high frequency band, the regions 1210-1, 1210-2, and 1210-M may collectively provide two three-column high-band arrays. For example, a first high-band array may include the vertical columns 1220-1, 1220-2, and 1220-3, and a second high-band array may include the vertical columns 1220-4, 1220-5, and 1220-6. In each of the high-band arrays, one of the vertical columns 1220 (e.g., in the region 1210-M) may not be tilted, but rather may have an adjusted phase.

In some embodiments, a low-band vertical column 1230 may be on the flat middle portion 104-M between the vertical columns 1220-3 and 1220-4. Accordingly, high-band radiating elements 122 and low-band radiating elements 1021 may be on the same flat surface of the reflector 102. By adjusting the phase at radiating elements 122 on the flat middle portion 104-M, twin-beam performance with a beamwidth of about 33° in a high frequency band can be improved. Moreover, to accommodate the combination of radiating elements 122 and radiating elements 1021, the flat middle portion 104-M may be relatively wide in the horizontal direction H, thus allowing radiating elements 1021 to "see" more of the reflector 102. For example, the flat middle portion 104-M may be approximately equal in width to each of the tilted portions 104-1 and 104-2. Because it has a single reflector 102 for all radiating elements 122 and 1021, the antenna 1200 may also be easier to manufacture than an antenna that has high-band radiating elements and low-band radiating elements on separate reflectors.

Figure 13A:
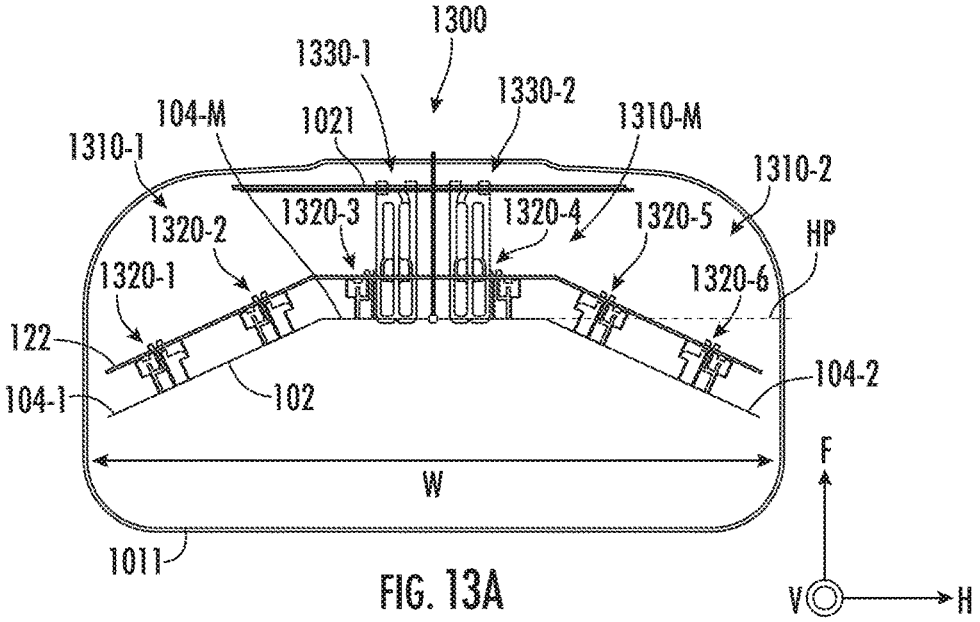
FIG. 13A is a transverse cross-sectional view of a twin-beam base station antenna according to embodiments of the present invention.

FIG. 13A is a transverse cross-sectional view of a twin-beam base station antenna 1300 according to embodiments of the present invention. Similar to the base station antenna 1200 (FIG. 12A), the antenna 1300 may include both high-band radiating elements 122 and low-band radiating elements 1021 on a flat middle portion 104-M of a reflector 102. For example, a first high-band region 1310-1 may include vertical columns 1320-1 and 1320-2 on a first tilted portion 104-1 of the reflector 102, a second high-band region 1310-2 may include vertical columns 1320-5 and 1320-6 on a second tilted portion 104-2 of the reflector 102, and a middle, third high-band region 1310-M may include vertical columns 1320-3 and 1320-4 on the flat middle portion 104-M. To achieve an azimuth beamwidth of about 33° in a high frequency band, the regions 1310-1, 1310-2, and 1310-M may collectively provide two three-column high-band arrays.

In contrast with the antenna 1200, however, the antenna 1300 may include a first vertical column 1330-1 of low-band radiating elements 1021 and a second vertical column 1330-2 of low-band radiating elements 1021 that is vertically staggered relative to the first vertical column 1330-1. The vertical columns 1330-1 and 1330-2 may both be on the flat middle portion 104-M. The vertical columns 1330-1 and 1330-2 may be part of the same low-band array, and the radiating elements 1021 may be staggered among the different vertical columns 1330-1 and 1330-2 to decrease the azimuth beamwidth of the low-band array.

Figure 13B:
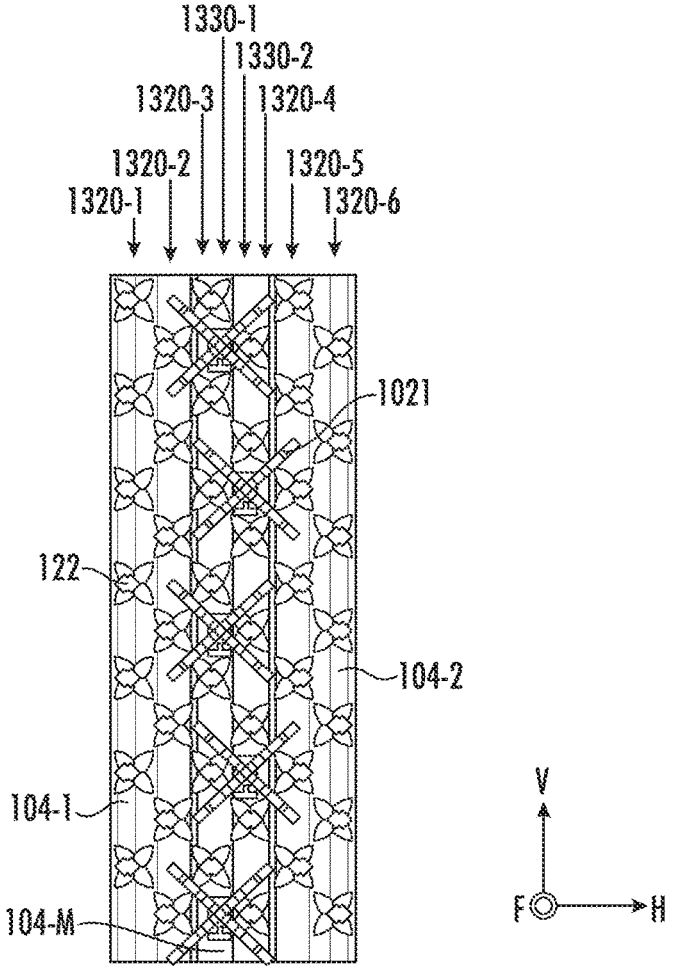
FIG. 13B is a schematic front view of the base station antenna of FIG. 13A.

FIG. 13B is a schematic front view of the base station antenna 1300 of FIG. 13A with the radome 1011 removed. As shown in FIG. 13B, each radiating element 1021 of the vertical column 1330-1 may be between, in the vertical direction V, a pair of radiating elements 122 of the vertical column 1320-3. Similarly, each radiating element 1021 of the vertical column 1330-2 may be between, in the vertical direction V, a pair of radiating elements 122 of the vertical column 1320-4. Moreover, in some embodiments, the vertical columns 1330-1 and 1330-2 may collectively include no more than five radiating elements 1021. For example, the vertical column 1330-1 may have only three radiating elements 1021 and the vertical column 1330-2 may have only two radiating elements 1021.

Figure 14A:
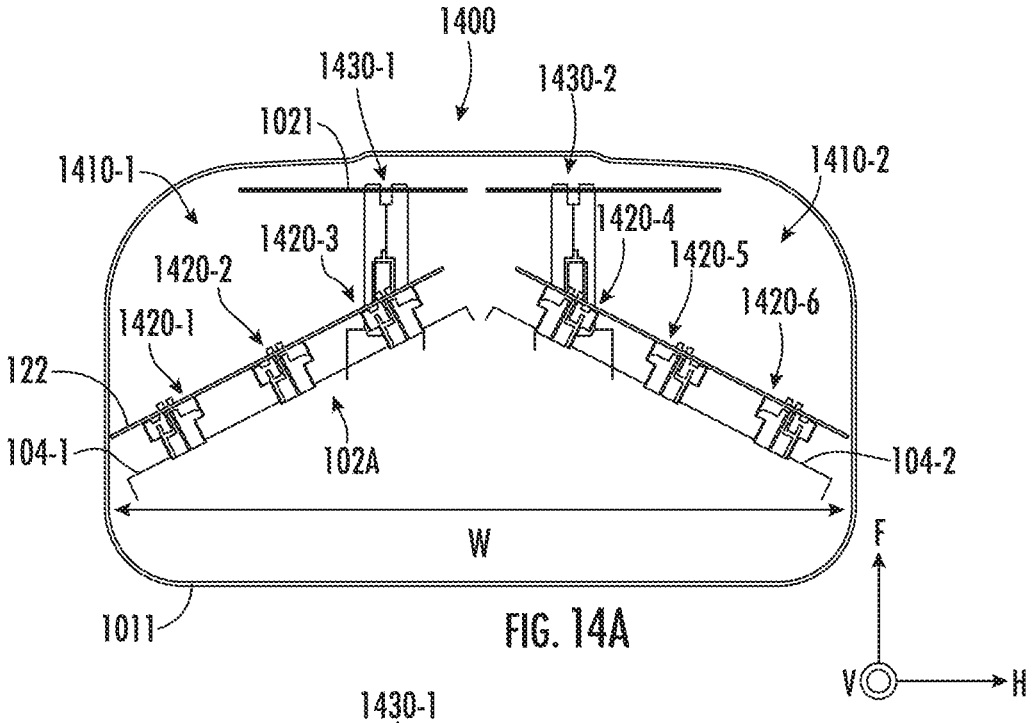
FIG. 14A is a transverse cross-sectional view of a twin-beam base station antenna according to embodiments of the present invention.

FIG. 14A is a transverse cross-sectional view of a twin-beam base station antenna 1400 according to embodiments of the present invention. The antenna 1400 includes a reflector arrangement 102A in which all high-band radiating elements 122 and all low-band radiating elements 1021 are distributed among a first tilted portion 104-1 and a second tilted portion 104-2 of the reflector arrangement 102A, which may be sheet metal. The reflector arrangement 102A does not have a flat middle portion 104-M (FIG. 10A) or a recessed flat middle portion 104-RM (FIG. 10B), and thus may reduce costs. Accordingly, the tilted portions 104-1 and 104-2 may, in some embodiments, be respective reflector surfaces that are tilted relative to each other and are not connected by a flat surface therebetween. The tilted portions 104-1 and 104-2 of the reflector arrangement 102A may thus be two separate reflectors, respectively.

A first high-band array 1410-1 of the antenna 1400 may include vertical columns 1420-1, 1420-2, and 1420-3 on the tilted portion 104-1, and a second high-band array 1410-2 of the antenna 1400 may include vertical columns 1420-4, 1420-5, and 1420-6 on the tilted portion 104-2. A first low-band region 1430-1 may also be on the tilted portion 104-1, and a second low-band region 1430-2 may also be on the tilted portion 104-2. Moreover, though FIG. 14A illustrates radiating elements 1021, the regions 1430-1 and 1430-2 may, in some embodiments, alternatively use compact/low-cost radiating elements 1021L (FIG. 11A).

Figure 14B:
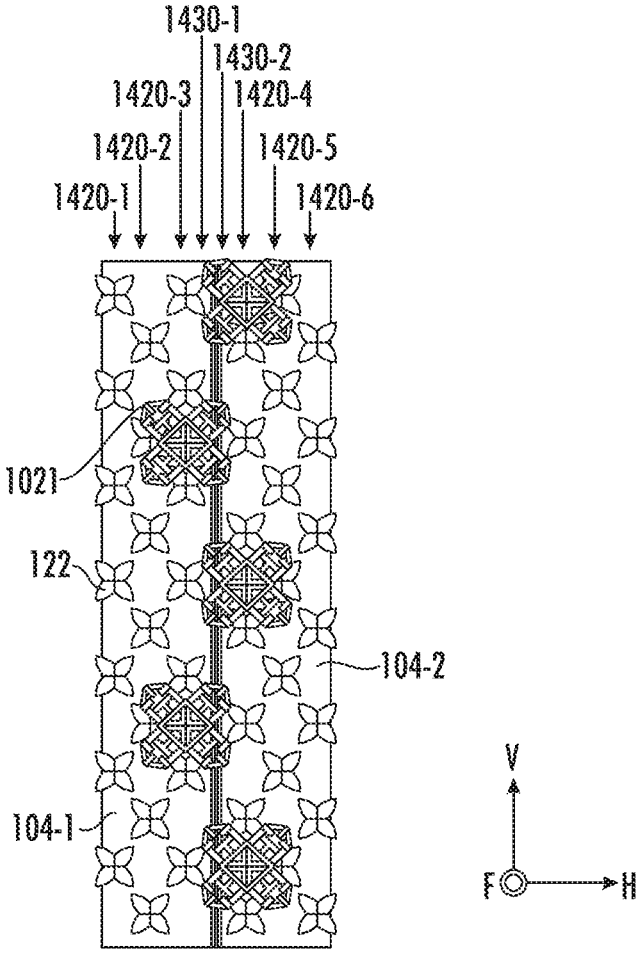
FIG. 14B is a schematic front view of the base station antenna of FIG. 14A.

FIG. 14B is a schematic front view of the base station antenna 1400 of FIG. 14A with the radome 1011 removed. As shown in FIG. 14B, consecutive ones of the vertical columns 1420-1 through 1420-6 may be vertically staggered. In some embodiments, each low-band radiating element 1021 in the region 1430-1 may be between, in the vertical direction V, a pair of high-band radiating elements 122 of the vertical column 1420-3. Similarly, each low-band radiating element 1021 in the region 1430-2 may be between, in the vertical direction V, a pair of high-band radiating elements 122 of the vertical column 1420-4. For example, the region 1430-1 may be a single vertical column that is aligned, in the vertical direction V, with the vertical column 1420-3, and the region 1430-2 may be a single vertical column that is aligned, in the vertical direction V, with the vertical column 1420-4. The regions 1430-1 and 1430-2 may be part of the same staggered low-band array.

Figure 15A:
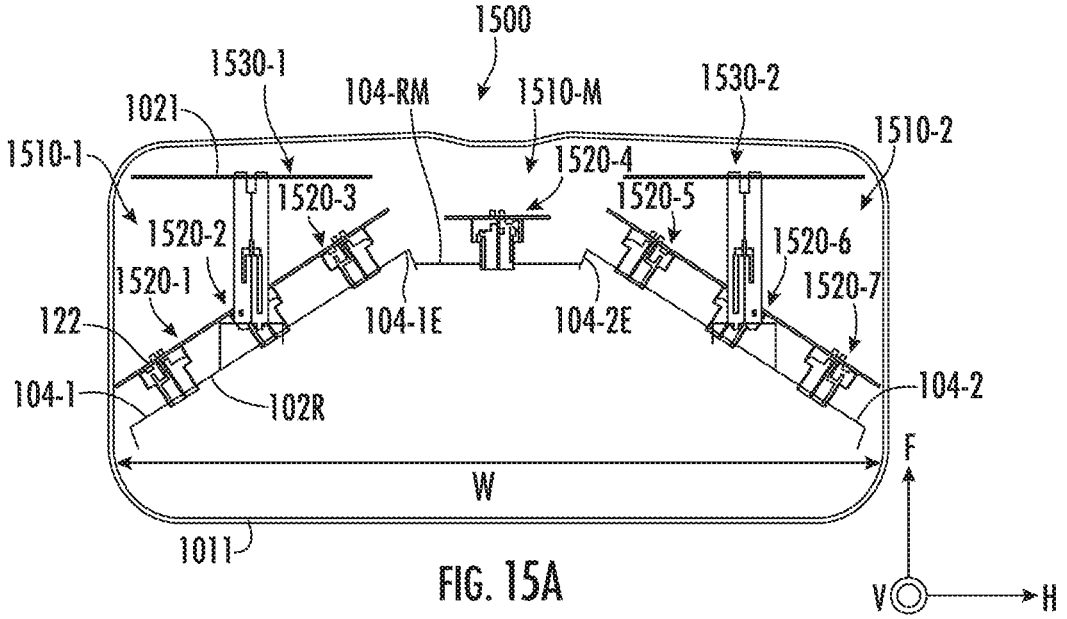
FIG. 15A is a transverse cross-sectional view of a twin-beam base station antenna according to embodiments of the present invention.

FIG. 15A is a transverse cross-sectional view of a twin-beam base station antenna 1500 according to embodiments of the present invention. The antenna 1500 has a reflector 102R that includes a recessed flat middle portion 104-RM between tilted portions 104-1 and 104-2. A first high-band array 1510-1 and a first low-band array 1530-1 may both be on the tilted portion 104-1. A second high-band array 1510-2 and a second low-band array 1530-2 may both be on the tilted portion 104-2. Moreover, a middle, third high-band array 1510-M may be on the recessed flat middle portion 104-RM.

The recessed flat middle portion 104-RM may be a flat surface that is recessed relative to respective adjacent ends 104-1E and 104-2E of the tilted portions 104-1 and 104-2. Accordingly, the recessed flat middle portion 104-RM may be referred to herein as a "recessed flat middle reflector surface." To provide separation between the low-band arrays 1530-1 and 1530-2, the recessed flat middle portion 104-RM may include only high-band radiating elements 122 (i.e., no low-band radiating elements 1021). Moreover, to reduce coupling due to the high-band array 1510-M, a width W of the antenna 1500 may, in some embodiments, be wider than that of the antennas 1000 (FIG. 10A), 1000R (FIG. 10B), 1100 (FIG. 11A), 1200 (FIG. 12A), 1300 (FIG. 13A), and 1400 (FIG. 14A). For example, the width of the antenna 1500 may be up to 498 mm.

Figure 15B:
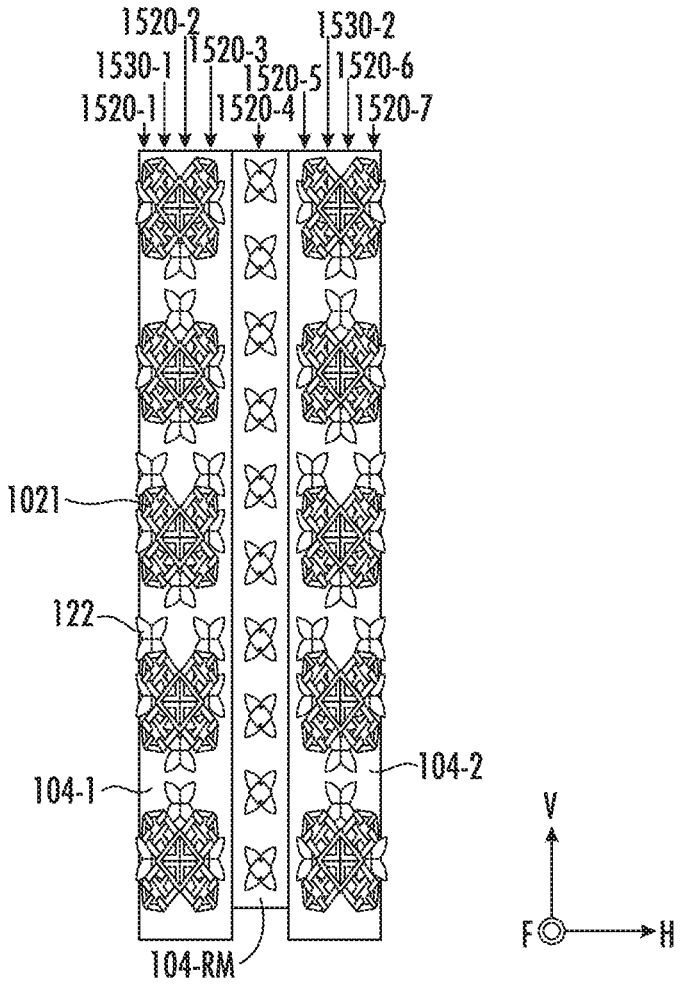
FIGS. 15B and 15C are schematic front views of the base station antenna of FIG. 15A.
Figure 15C:
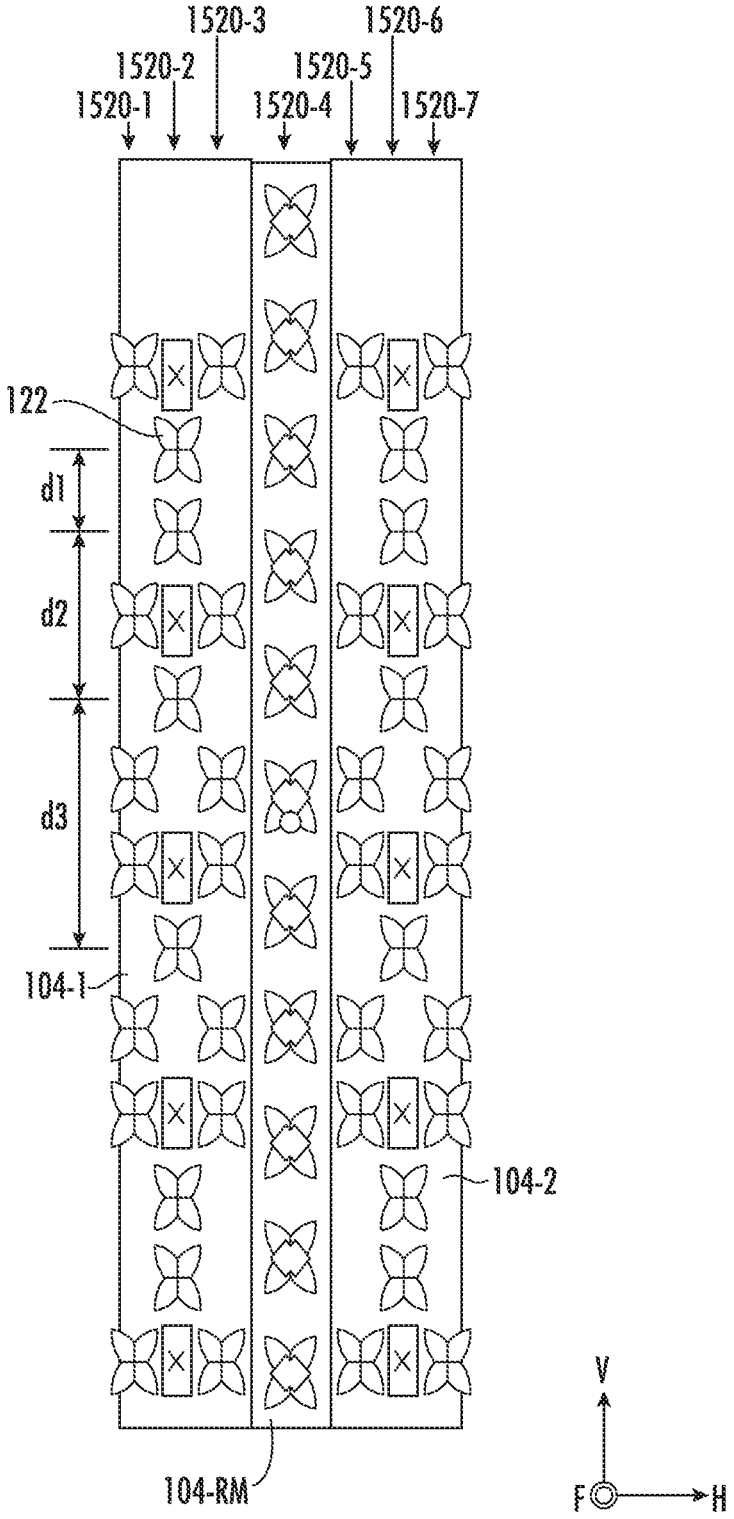

FIGS. 15B and 15C are schematic front views of the base station antenna 1500 of FIG. 15A with the radome 1011 removed. As shown in FIGS. 15A-15C, the array 1510-1 may include vertical columns 1520-1, 1520-2, and 1520-3 on the tilted portion 104-1, the array 1510-2 may include vertical columns 1520-5, 1520-6, and 1520-7 on the tilted portion 104-2, and the array 1510-M may include a single vertical column 1520-4 on the recessed flat middle portion 104-RM. In some embodiments, the array 1530-1 may be a single vertical column of low-band radiating elements 1021 that are aligned in the vertical direction V with high-band radiating elements 122 of the vertical column 1520-2, and the array 1530-2 may be a single vertical column of low-band radiating elements 1021 that are aligned in the vertical direction V with high-band radiating elements 122 of the vertical column 1520-6. By having only high-band radiating elements 122 on the recessed flat middle portion 104-RM, the antenna 1500 may provide increased low-band separation for the arrays 1530-1 and 1530-2.

Consecutive ones of the vertical columns 1520-1, 1520-2, and 1520-3 may be vertically staggered. Accordingly, the vertical column 1520-2 may be vertically staggered relative to both of the vertical columns 1520-1 and 1520-3. Similarly, consecutive ones of the vertical columns 1520-5, 1520-6, and 1520-7 may be vertically staggered.

FIG. 15C also illustrates a high-band triangular arrangement in which triangle shapes (i.e., trios of high-band radiating elements 122) are alternately inverted along the vertical direction V. Accordingly, consecutive triangle shapes in the vertical direction V are inverted relative to each other. To achieve these shapes, each vertical column 1520 may have three different center-to-center vertical distances d1, d2, and d3 between consecutive ones of its radiating elements 122. For example, given four consecutive radiating elements 122 in the vertical column 1520-2, the first and second radiating elements 122 may have the first distance d1, the second and third radiating elements 122 may have the second distance d2, and the third and fourth radiating elements 122 may have the third distance d3. The second distance d2 may be twice the first distance d1, and the third distance d3 may be triple the first distance d1. As a result of the different vertical distances d1, d2, and d3 and the vertical stagger between consecutive vertical columns 1520, mutual coupling between radiating elements 122 may be reduced.

Figure 15D:
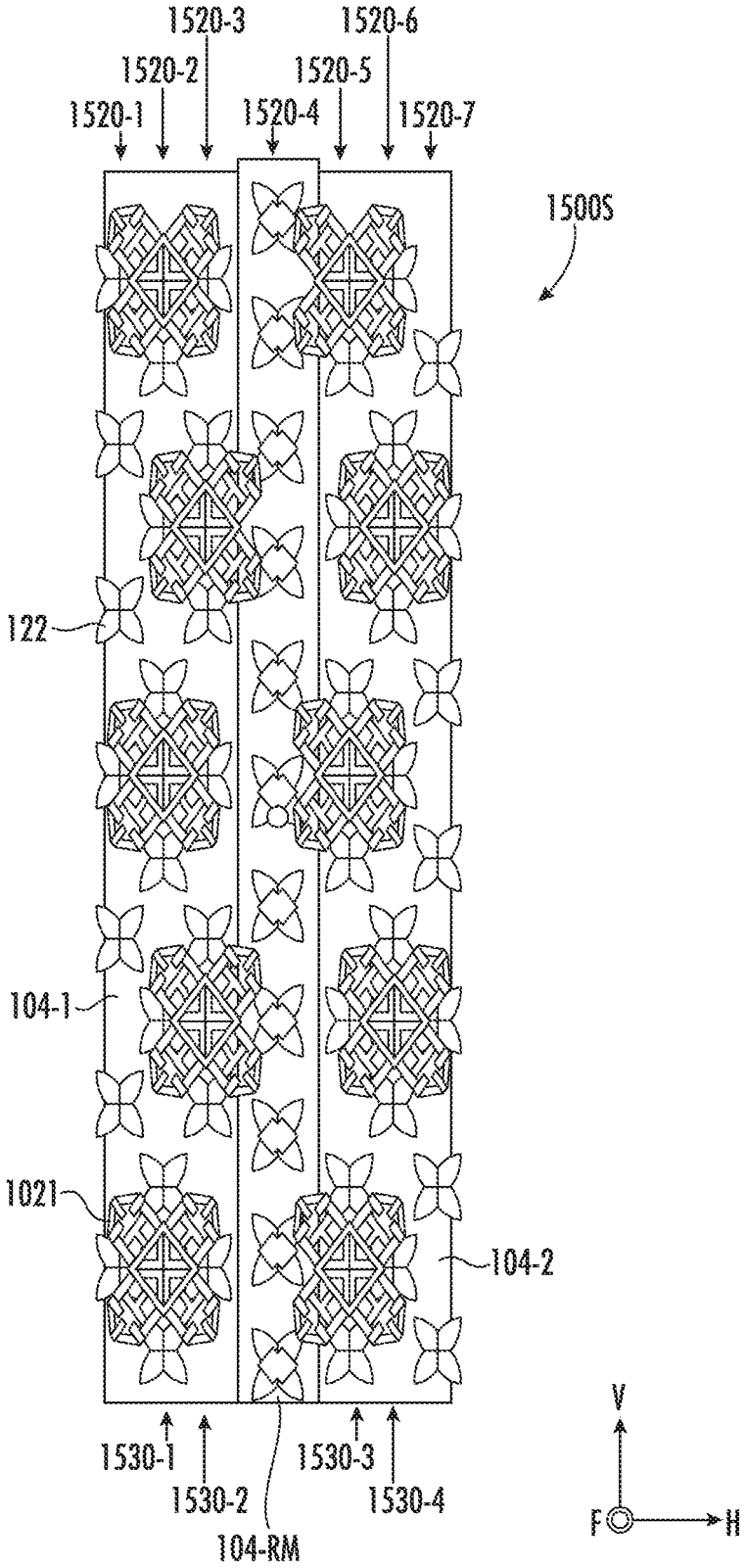
FIG. 15D is a schematic front view of a twin-beam base station antenna according to embodiments of the present invention.

FIG. 15D is a schematic front view of a twin-beam base station antenna 1500S (with its radome removed) according to embodiments of the present invention. Similar to the antenna 1500 (FIG. 15A), the antenna 1500S includes the high-band vertical columns 1520-1 through 1520-7, where the vertical column 1520-4 is on the recessed flat middle portion 104-RM. Unlike the antenna 1500, however, low-band vertical columns 1530 of the antenna 1500S are vertically staggered relative to each other. Specifically, the tilted portion 104-1 has vertical columns 1530-1 and 1530-2 that are vertically staggered relative to each other, and the tilted portion 104-2 has vertical columns 1530-3 and 1530-4 that are vertically staggered relative to each other. For example, the vertical columns 1530-1 and 1530-2 may be aligned in the vertical direction V with the vertical columns 1520-2 and 1520-3, respectively, and the vertical columns 1530-3 and 1530-4 may be aligned in the vertical direction V with the vertical columns 1520-5 and 1520-6, respectively. In some embodiments, the vertical columns 1530-1 and 1530-2 may be part of the same first staggered low-band array, and the vertical columns 1530-3 and 15304 may be part of the same second staggered low-band array.

As shown in FIGS. 10A-15D, low-band radiating elements 1021 can be integrated with a twin-beam layout of high-band radiating elements 122. For example, the radiating elements 1021 can share one or more reflector surfaces with the radiating elements 122, or the radiating elements 1021 may be on their own surface that faces in a direction different from those of reflector surfaces of the radiating elements 122. In some embodiments, due to a triangular arrangement of the radiating elements 122, each high-band vertical column may have no more than seven radiating elements 122. Moreover, each low-band vertical column may have no more than five radiating elements 1021. By integrating the radiating elements 1021 with the radiating elements 122, the antennas 1000 (FIG. 10A), 1000R (FIG. 10B), 1100 (FIG. 11A), 1200 (FIG. 12A), 1300 (FIG. 13A), 1400 (FIG. 14A), 1500 (FIG. 15A), and 1500S (FIG. 15D) may provide a beamwidth of, for example, about 65° in a low frequency band, in addition to a twin-beam beamwidth of about 33° in a high frequency band.

It will be appreciated that the present specification only describes a few example embodiments of the present invention and that the techniques described herein have applicability beyond the example embodiments described above.

The description above primarily describes the transmit paths through the base station antennas described herein. It will be appreciated that base station antennas include bi-directional RF signal paths, and that the base station antennas will also be used to receive RF signals. In the receive path, RF signals will typically be combined whereas the RF signals are split in the transmit path. Thus, it will be apparent to the skilled artisan that the base station antennas described herein may be used to receive RF signals.

Embodiments of the present invention have been described above with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

It will be understood that when an element is referred to as being "on" another element, it can be directly on the other element or intervening elements may also be present. In contrast, when an element is referred to as being "directly on" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (i.e., "between" versus "directly between", "adjacent" versus "directly adjacent", etc.).

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features, operations, elements, and/or components, but do not preclude the presence or addition of one or more other features, operations, elements, components, and/or groups thereof.

Aspects and elements of all of the embodiments disclosed above can be combined in any way and/or combination with aspects or elements of other embodiments to provide a plurality of additional embodiments.

That which is claimed is:

1. A twin beam base station antenna, comprising:

an angled reflector having a first planar panel and a second planar panel that is angled with respect to the first planar panel;

a first array that includes a first plurality of radiating elements that are mounted to extend forwardly from the first planar panel, where the radiating elements extend in three vertically-extending columns, and the radiating elements in the middle of the three vertically-extending columns are vertically offset from the radiating elements in the other two of the three vertically-extending columns;

a second array that includes a second plurality of radiating elements that are mounted to extend forwardly from the second planar panel, where the radiating elements extend in three vertically-extending columns, and the radiating elements in the middle of the three vertically-extending columns are vertically offset from the radiating elements in the other two of the three vertically-extending columns;

a first phase shifter having an input and a plurality of first phase shifter outputs;

a second phase shifter having an input and a plurality of second phase shifter outputs;

wherein more than half of the first phase shifter outputs are connected to respective ones of a plurality of first sub-arrays, where each first sub-array includes a total of one radiating element from each of the three columns in the first array, wherein more than half of the second phase shifter outputs are connected to respective ones of a plurality of second sub-arrays, where each second sub-array includes a total of one radiating element from each of the three columns in the second array.

2. The lensed base station antenna according to claim 1, wherein the three radiating elements included in each first sub-array are arranged to define a triangle, and wherein the three radiating elements included in each second sub-array are arranged to define a triangle.

3. The lensed base station antenna according to claim 2, wherein the three radiating elements included in each first sub-array are mounted on a common feed board printed circuit board that includes a pair of 1×3 power dividers, and wherein the three radiating elements included in each second sub-array are mounted on a common feed board printed circuit board that includes a pair of the 1×3 power dividers.

4. The lensed base station antenna according to claim 2, wherein the three radiating elements included in each first sub-array include radiating elements in the outer columns that are horizontally aligned with each other, and a radiating element in the middle column that is vertically offset from the radiating elements in the outer columns.

5. The lensed base station antenna according to claim 1, wherein the outer columns in the first array and the outer columns in the second array are separated in the horizontal direction by between 0.5λ and 0.95λ, where λ is the wavelength corresponding to the center frequency of the operating frequency bands of the first and second arrays.

6. The lensed base station antenna according to claim 5, wherein the radiating elements in the middle column of the first array are offset in the vertical direction by between 0.6λ and 0.9λ from the closest radiating elements in the outer columns in the first array, and the radiating elements in the middle column of the second array are offset in the vertical direction by between 0.6λ and 0.9λ from the closest radiating elements in the outer columns in the second array where λ is the wavelength corresponding to the center frequency of the operating frequency bands of the first and second arrays.

7. The lensed base station antenna according to claim 3, wherein the 1×3 power dividers are unequal power dividers and provide a larger amount of power to radiating elements in the middle column than to the radiating elements in the out columns.

8. The lensed base station antenna according to claim 1, wherein one of the first phase shifter outputs is connected to a third sub-array that includes a total of one radiating element from each of the outer columns in the first array, and wherein one of the second phase shifter outputs is connected to a fourth sub-array that includes a total of one radiating element from each of the outer columns in the second array.

9. The lensed base station antenna according to claim 8, wherein the first array includes an equal number of first sub-arrays both above and below the third sub-array, and wherein the second array includes an equal number of second sub-arrays both above and below the fourth sub-array.

10. The lensed base station antenna according to claim 1, wherein each first sub-array includes a V-shaped feedboard or a triangular shaped feedboard.

11. The lensed base station antenna according to claim 1, wherein the outer columns in the first array and the outer columns in the second array are separated in the horizontal direction by between 0.6λ and 0.85λ, where λ is the wavelength corresponding to the center frequency of the operating frequency bands of the first and second arrays, wherein the radiating elements in the middle column of the first array are offset in the vertical direction by between 0.7λ and 0.8λ from the closest radiating elements in the outer columns in the first array, and the radiating elements in the middle column of the second array are offset in the vertical direction by between 0.7λ and 0.8λ from the closest radiating elements in the outer columns in the second array where λ is the wavelength corresponding to the center frequency of the operating frequency bands of the first and second arrays, and wherein each radiating element is configured to operate in at least a portion of the 1.695 MHz to 2.690 MHz frequency band.

12. A twin beam base station antenna, comprising:

an angled reflector having a first planar panel and a second planar panel that is angled with respect to the first planar panel;

a first array that includes a first plurality of radiating elements that are mounted to extend forwardly from the first planar panel, where the radiating elements extend in three vertically-extending columns, and the radiating elements in the middle of the three vertically-extending columns are vertically offset from the radiating elements in the other two of the three vertically-extending columns; and a second array that includes a second plurality of radiating elements that are mounted to extend forwardly from the second planar panel, where the radiating elements extend in three vertically-extending columns, and the radiating elements in the middle of the three vertically-extending columns are vertically offset from the radiating elements in the other two of the three vertically-extending columns;

wherein the first and third columns in the first array and the first and third columns in the second array are separated by between 0.5λ and 0.95λ, where λ is the wavelength corresponding to the center frequency of the operating frequency bands of the first and second arrays;

wherein the radiating elements in the second column of the first array are offset in the vertical direction by between 0.6λ and 0.9λ from the closest radiating elements in the first and third columns in the first array, and the radiating elements in the second column of the second array are offset in the vertical direction by between 0.6λ and 0.9λ from the closest radiating elements in the first and third columns in the second array.

13. The lensed base station antenna according to claim 12, wherein all of the first phase shifter outputs are connected to respective ones of a plurality of first sub-arrays, where each first sub-array includes a total of one radiating element from each of the three columns in the first array, and wherein all of the second phase shifter outputs are connected to respective ones of a plurality of second sub-arrays, where each second sub-array includes a total of one radiating element from each of the three columns in the second array.

14. The lensed base station antenna according to claim 12, wherein all but one of the first phase shifter outputs are connected to respective ones of a plurality of first sub-arrays, where each first sub-array includes a total of one radiating element from each of the three columns in the first array, and wherein all but one of the second phase shifter outputs are connected to respective ones of a plurality of second sub-arrays, where each second sub-array includes a total of one radiating element from each of the three columns in the second array.

15. The lensed base station antenna according to claim 12, wherein the three radiating elements included in each first sub-array are arranged to define a triangle, and wherein the three radiating elements included in each second sub-array are arranged to define a triangle.

16. The lensed base station antenna according to claim 12, wherein the three radiating elements included in each first sub-array are mounted on a common feed board printed circuit board that includes a pair of 1×3 power dividers, and wherein the three radiating elements included in each second sub-array are mounted on a common feed board printed circuit board that includes a pair of the 1×3 power dividers.

17. A base station antenna comprising:

a reflector comprising first and second tilted portions and a flat middle portion that is between the first and second tilted portions;

a vertical column of low-band radiating elements on the flat middle portion of the reflector;

a first vertically-staggered plurality of vertical columns of high-band radiating elements on the first tilted portion of the reflector; and a second vertically-staggered plurality of vertical columns of high-band radiating elements on the second tilted portion of the reflector, wherein an innermost one of the first vertically-staggered plurality of vertical columns is vertically staggered relative to an innermost one of the second vertically-staggered plurality of vertical columns.

18. The base station antenna of claim 17, further comprising a third vertically-staggered plurality of vertical columns of high-band radiating elements on the flat middle portion of the reflector.

19. The base station antenna of claim 18, wherein the first vertically-staggered plurality of vertical columns comprises consecutive first and second vertical columns of high-band radiating elements, wherein the third vertically-staggered plurality of vertical columns comprises consecutive third and fourth vertical columns of high-band radiating elements, wherein the second vertically-staggered plurality of vertical columns comprises consecutive fifth and sixth vertical columns of high-band radiating elements, wherein the first vertical column of high-band radiating elements is aligned in a horizontal direction with the third and fifth vertical columns of high-band radiating elements, and wherein the second vertical column of high-band radiating elements is aligned in the horizontal direction with the fourth and sixth vertical columns of high-band radiating elements.

20. The base station antenna of claim 17, wherein the flat middle portion of the reflector is recessed relative to respective ends of the first and second tilted portions of the reflector that are adjacent the flat middle portion.

21. The base station antenna of claim 17, wherein the vertical column of low-band radiating elements comprises a first vertical column of low-band radiating elements, and wherein the base station antenna further comprises a second vertical column of low-band radiating elements on the flat middle portion of the reflector and vertically staggered relative to the first vertical column of low-band radiating elements.

* * * * *